US010030647B2

(12) United States Patent
Ortiz et al.

(10) Patent No.: US 10,030,647 B2
(45) Date of Patent: Jul. 24, 2018

(54) UNIVERSAL MOUNT FOR A VARIABLE SPEED PUMP DRIVE USER INTERFACE

(75) Inventors: Gary Ortiz, Clemmons, NC (US); Jason W. Parcell, Winston-Salem, NC (US); Dwayne Emory Clark, Summerfield, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 120 days.

(21) Appl. No.: 13/034,389

(22) Filed: Feb. 24, 2011

(65) Prior Publication Data

US 2011/0280744 A1 Nov. 17, 2011

Related U.S. Application Data

(60) Provisional application No. 61/308,241, filed on Feb. 25, 2010.

(51) Int. Cl.
*F04B 49/06* (2006.01)
*F04B 39/14* (2006.01)
(Continued)

(52) U.S. Cl.
CPC ..... *F04B 49/065* (2013.01); *F04B 39/14* (2013.01); *F04B 53/22* (2013.01);
(Continued)

(58) Field of Classification Search
CPC ..... F04B 27/0895; F04B 39/14; F04B 53/22; F04B 49/06; F04B 49/065; F04B 49/00–49/51; F04B 19/00; F04B 19/20–19/22; F04B 37/00; F04D 13/06; F04D 13/0686; F04D 13/0693; F04D 25/0693; F04D 25/068; F04D 29/60; F04D 29/605; F04D 29/628; G06F 1/1601
(Continued)

(56) References Cited

U.S. PATENT DOCUMENTS 2,096,595 A 10/1937 Sanford
2,250,021 A 7/1941 Hofer
(Continued)

FOREIGN PATENT DOCUMENTS

AU 2005204246 A1 3/2006
AU 2007332716 A1 6/2008
(Continued)

OTHER PUBLICATIONS

Sanderfoot, Alan E., "Too Late, But Not Too Little", Aqua—The Business Magazine for Spa & Pool Professionals, Jul. 1996, vol. 21, No. 7, p. 8 (1 page).
(Continued)

*Primary Examiner* — Alexander Comley
(74) *Attorney, Agent, or Firm* — McCarter & English, LLP

(57) ABSTRACT

Disclosed herein is a user interface that can be universally mounted to a combination variable speed pump and a drive assembly therefor. The user interface is universally configured to be selectively mounted to the drive assembly and/or to an environmental surface that is remotely located from the drive assembly. The user interface is universally configured to be selectively mounted to the drive assembly in any one of a plurality of available positions relative thereto.

61 Claims, 16 Drawing Sheets

(51) Int. Cl.

| | |
|---|---|
| ***F04B 53/22*** | (2006.01) |
| ***F04D 13/06*** | (2006.01) |
| ***F04D 25/06*** | (2006.01) |
| *F04B 17/03* | (2006.01) |
| *F04D 15/00* | (2006.01) |

(52) U.S. Cl.
CPC ..... *F04D 13/0686* (2013.01); *F04D 25/068* (2013.01); *F04B 17/03* (2013.01); *F04D 13/0693* (2013.01); *F04D 15/0066* (2013.01); *F04D 25/0693* (2013.01); *Y10T 29/49826* (2015.01)

(58) Field of Classification Search
USPC .... 417/423.15, 313, 63, 238, 360, 361, 572; 29/525.11, 428; 341/22; 340/693, 9, 340/693.12; 361/679.11, 679.17, 679.06, 361/679.01–679.02; 379/433.07; 345/168, 169; 200/314
See application file for complete search history.

(56) References Cited

U.S. PATENT DOCUMENTS 2,572,263 A 10/1951 Hofer
2,603,234 A 7/1952 Hofer
2,644,400 A 7/1953 Hofer
2,680,168 A 6/1954 Murphy
2,767,277 A 10/1956 With
2,889,779 A 6/1959 Hofer
3,145,724 A 8/1964 Pelzer
3,195,556 A 7/1965 Norstrud et al.
3,252,479 A 5/1966 Klock, Jr.
3,781,925 A 1/1974 Curtis et al.
3,893,525 A 7/1975 Dower et al.
3,917,436 A 11/1975 Dower
3,957,395 A 5/1976 Ensign
3,966,358 A 6/1976 Heimes et al.
4,107,492 A 8/1978 Moon, Jr. et al.
4,115,878 A 9/1978 Johnson et al.
4,116,577 A 9/1978 Lauck
4,180,374 A 12/1979 Bristow
4,278,403 A 7/1981 Shafer
4,322,297 A 3/1982 Bajka
4,329,120 A 5/1982 Walters
4,402,094 A 9/1983 Sanders
4,421,643 A 12/1983 Frederick
4,424,438 A 1/1984 Antelman et al.
4,444,546 A 4/1984 Pazemenas
4,456,432 A 6/1984 Mannino
4,505,643 A 3/1985 Millis et al.
4,525,125 A 6/1985 Matsumtot et al.
4,556,807 A 12/1985 Yamada et al.
4,558,238 A 12/1985 Yamada et al.
4,602,391 A 7/1986 Sheperd
4,616,215 A 10/1986 Maddalena
4,620,835 A 11/1986 Belll
4,659,235 A 4/1987 Gilmore et al.
4,663,613 A 5/1987 Raleigh et al.
4,676,914 A 6/1987 Mills et al.
4,686,439 A 8/1987 Cunningham et al.
4,724,074 A 2/1988 Schaupp
4,742,456 A 5/1988 Kamena
4,749,377 A 6/1988 Mendizabal et al.
4,781,536 A 11/1988 Hicks
4,797,958 A 1/1989 Guzzini
4,799,048 A 1/1989 Goshima et al.
4,810,169 A * 3/1989 Kranzle ..... 417/63
4,861,231 A 8/1989 Howard
4,867,645 A 9/1989 Foster
4,913,625 A 4/1990 Gerlowski
5,006,044 A 4/1991 Walker, Sr. et al.
5,040,950 A * 8/1991 Dalquist et al. ..... 417/234
5,057,081 A * 10/1991 Sunderland et al. ..... 604/153
5,064,347 A 11/1991 La Valley, Sr.
5,076,761 A 12/1991 Krohn et al.
5,076,763 A 12/1991 Anastos et al.
5,120,198 A 6/1992 Clark
5,146,943 A 9/1992 Bert
5,167,041 A 12/1992 Burkitt, III
5,190,442 A 3/1993 Jorritsma
5,221,189 A 6/1993 Henningsen
5,240,379 A 8/1993 Takashi et al.
5,244,351 A 9/1993 Arnette
5,251,125 A 10/1993 Kamowski et al.
5,259,733 A 11/1993 Gigliotti et al.
5,278,455 A 1/1994 Hamos
5,294,045 A 3/1994 Harris
5,347,664 A 9/1994 Hamza et al.
5,361,215 A 11/1994 Tompkins et al.
5,365,964 A 11/1994 Sorensen
5,410,150 A 4/1995 Teron et al.
5,415,221 A 5/1995 Zakryk
5,422,014 A 6/1995 Allen et al.
5,464,327 A 11/1995 Horwitz
5,466,995 A 11/1995 Genga
5,475,619 A 12/1995 Sugano et al.
5,499,406 A 3/1996 Chalberg et al.
5,545,012 A 8/1996 Anastos et al.
5,550,753 A 8/1996 Tompkins et al.
5,559,720 A 9/1996 Tompkins et al.
5,570,481 A 11/1996 Mathis et al.
5,580,221 A 12/1996 Triezenberg
5,582,509 A 12/1996 Quilty et al.
5,585,025 A 12/1996 Idland
5,601,413 A 2/1997 Langley et al.
5,602,670 A 2/1997 Kegan
5,616,239 A 4/1997 Wendell et al.
5,658,131 A 8/1997 Aoki et al.
5,672,049 A 9/1997 Ciurlo
5,672,050 A 9/1997 Webber et al.
5,682,624 A 11/1997 Ciochetti
5,682,684 A 11/1997 Wentzlaff et al.
5,690,476 A 11/1997 Miller
5,707,211 A 1/1998 Kochan, Sr.
5,725,359 A 3/1998 Dongo et al.
5,730,861 A 3/1998 Sterghos et al.
5,739,648 A 4/1998 Ellis et al.
5,742,241 A * 4/1998 Crowley et al. ..... 341/22
5,759,414 A 6/1998 Wilkes et al.
5,772,403 A 6/1998 Allison et al.
5,795,328 A 8/1998 Barnitz et al.
5,796,184 A 8/1998 Kuhnl et al.
5,809,796 A 9/1998 Zakryk
5,822,807 A 10/1998 Gallagher et al.
5,846,056 A 12/1998 Dhindsa et al.
5,865,601 A 2/1999 Miller
5,894,609 A 4/1999 Barnett
5,895,565 A 4/1999 Steininger et al.
5,898,958 A 5/1999 Hall
5,909,372 A 6/1999 Thybo
5,947,689 A 9/1999 Schick
5,947,700 A 9/1999 McKain et al.
5,971,712 A 10/1999 Kann
5,984,641 A 11/1999 Bevan et al.
5,991,939 A 11/1999 Mulvey
6,003,165 A 12/1999 Loyd
6,038,712 A 3/2000 Chalberg et al.
6,039,543 A 3/2000 Littleton
6,041,801 A 3/2000 Gray et al.
6,045,331 A 4/2000 Gehm
6,053,193 A 4/2000 Baker et al.
6,059,536 A 5/2000 Stingl
6,065,941 A 5/2000 Gray
6,098,648 A 8/2000 Bertoia
6,098,654 A 8/2000 Cohen et al.
6,099,264 A 8/2000 Du
6,123,510 A 9/2000 Greer et al.
6,171,073 B1 1/2001 McKain et al.
6,186,167 B1 2/2001 Grumstrup et al.
6,208,262 B1 * 3/2001 Jones ..... 340/693.5
6,227,808 B1 5/2001 McDonough
6,251,285 B1 6/2001 Ciochetti
6,253,227 B1 6/2001 Tompkins et al.

(56) References Cited

U.S. PATENT DOCUMENTS 6,253,391 B1 7/2001 Watanabe et al.
6,261,065 B1 7/2001 Nayak et al.
6,269,493 B2 8/2001 Sorensen
6,273,686 B1 8/2001 Kroell et al.
6,295,661 B1 10/2001 Bromley
6,295,662 B1 10/2001 Idland et al.
6,329,778 B1 12/2001 Culp et al.
6,341,387 B1 1/2002 Zars
6,342,841 B1 1/2002 Stingl
6,374,854 B1 4/2002 Acosta
6,490,781 B2 5/2002 McDonough
6,407,469 B1 6/2002 Cline et al.
6,433,791 B2 * 8/2002 Selli et al. ..... 345/659
6,438,446 B1 8/2002 Trachier
6,445,332 B1 9/2002 Younger et al.
6,445,966 B1 9/2002 Younger et al.
6,461,113 B1 10/2002 Gaudet et al.
6,464,464 B2 10/2002 Sabini et al.
6,468,052 B2 10/2002 McKain et al.
6,497,554 B2 12/2002 Yang et al.
6,547,529 B2 4/2003 Gross
6,568,416 B2 5/2003 Tucker et al.
6,590,188 B2 7/2003 Cline et al.
6,591,863 B2 7/2003 Ruschell et al.
6,615,594 B2 9/2003 Jayanth et al.
6,623,245 B2 9/2003 Meza et al.
6,625,824 B1 9/2003 Lutz et al.
6,643,108 B2 11/2003 Cline et al.
6,651,900 B1 11/2003 Yoshida
6,657,546 B2 12/2003 Navarro et al.
6,659,980 B2 12/2003 Moberg et al.
6,662,384 B1 12/2003 Gardenier et al.
6,663,349 B1 12/2003 Discenzo et al.
6,676,382 B2 1/2004 Leighton et al.
6,676,831 B2 1/2004 Wolfe
6,687,923 B2 2/2004 Dick et al.
6,691,047 B1 2/2004 Fredericks
6,705,360 B1 * 3/2004 Bonzer ..... 141/38
6,709,240 B1 3/2004 Schmalz et al.
6,709,241 B2 3/2004 Sabini et al.
6,747,367 B2 6/2004 Cline et al.
6,770,043 B1 8/2004 Kahn
6,779,205 B2 8/2004 Mulvey et al.
6,783,328 B2 8/2004 Lucke et al.
6,796,776 B2 9/2004 Jolley et al.
6,810,915 B2 11/2004 Umetsu et al.
6,823,232 B2 * 11/2004 Murphy ..... 700/180
6,874,175 B2 4/2005 Laflamme et al.
6,902,378 B2 6/2005 Gaudet et al.
6,926,502 B2 * 8/2005 Lin et al. ..... 417/313
6,939,109 B2 9/2005 Takashi et al.
6,957,742 B1 10/2005 Pillart
6,976,052 B2 12/2005 Tompkins et al.
7,069,510 B2 6/2006 Anderson et al.
7,082,339 B2 7/2006 Murray et al.
7,085,627 B2 8/2006 Bamberger et al.
7,092,772 B2 8/2006 Murray et al.
7,103,428 B2 9/2006 Varone et al.
7,121,808 B2 * 10/2006 Van Brunt et al. ..... 417/42
7,122,928 B2 * 10/2006 Shindo ..... 310/89
D533,512 S 12/2006 Nakashima et al.
7,167,087 B2 1/2007 Corrington et al.
7,292,898 B2 11/2007 Clark et al.
D567,189 S 4/2008 Stiles, Jr. et al.
7,397,360 B2 7/2008 Corrington et al.
7,471,994 B2 12/2008 Ford et al.
7,473,080 B2 * 1/2009 Kawada et al. ..... 417/423.14
7,484,938 B2 2/2009 Allen
7,490,370 B2 2/2009 Macey et al.
D590,842 S * 4/2009 Clark et al. ..... D15/7
7,519,431 B2 4/2009 Goetz et al.
7,531,092 B2 5/2009 Hazlehurst
7,595,726 B2 * 9/2009 Nissels et al. ..... 340/539.29
7,686,589 B2 * 3/2010 Stiles et al. ..... 417/44.1
7,794,428 B2 * 9/2010 Estes et al. ..... 604/152
7,828,528 B2 11/2010 Estes et al.
7,845,913 B2 12/2010 Stiles, Jr. et al.
7,847,790 B2 12/2010 Bewley et al.
7,854,597 B2 12/2010 Stiles, Jr. et al.
7,874,808 B2 1/2011 Stiles
7,931,447 B2 4/2011 Levin et al.
8,019,479 B2 9/2011 Stiles, Jr. et al.
8,028,355 B2 10/2011 Reeder et al.
8,043,070 B2 10/2011 Stiles, Jr. et al.
8,313,306 B2 11/2012 Stiles, Jr. et al.
8,465,262 B2 6/2013 Stiles, Jr. et al.
8,469,675 B2 6/2013 Stiles, Jr. et al.
8,480,373 B2 7/2013 Stiles, Jr. et al.
8,500,413 B2 8/2013 Stiles, Jr. et al.
8,573,952 B2 11/2013 Stiles, Jr. et al.
8,602,743 B2 12/2013 Stiles, Jr. et al.
8,602,745 B2 12/2013 Stiles, Jr. et al.
8,801,389 B2 8/2014 Stiles, Jr. et al.
8,840,376 B2 9/2014 Stiles, Jr. et al.
9,051,930 B2 6/2015 Stiles, Jr. et al.
9,360,017 B2 * 6/2016 Hansen ..... F04D 15/0027
9,404,500 B2 8/2016 Stiles, Jr. et al.
9,551,344 B2 1/2017 Stiles, Jr. et al.
9,605,680 B2 3/2017 Stiles, Jr. et al.
2001/0041139 A1 11/2001 Sabini et al.
2002/0038169 A1 3/2002 Cline et al.
2002/0070611 A1 6/2002 Cline et al.
2002/0089236 A1 7/2002 Cline et al.
2002/0094277 A1 7/2002 Gaudet et al.
2002/0104158 A1 8/2002 Dick et al.
2002/0141877 A1 10/2002 Jayanth et al.
2002/0150476 A1 10/2002 Lucke et al.
2003/0006891 A1 1/2003 Wild et al.
2003/0044000 A1 * 3/2003 Kfoury ..... G06F 1/1626 379/433.04
2003/0049134 A1 3/2003 Leighton et al.
2003/0106147 A1 6/2003 Cohen et al.
2003/0114942 A1 6/2003 Varone et al.
2003/0143090 A1 * 7/2003 Iritani et al. ..... 417/410.5
2003/0172451 A1 9/2003 Loyd et al.
2003/0200761 A1 * 10/2003 Funahashi et al. ..... 62/228.4
2004/0140990 A1 * 7/2004 Prince et al. ..... 345/700
2004/0216225 A1 11/2004 Booth et al.
2004/0219025 A1 11/2004 Garcia-Ortiz
2005/0107896 A1 5/2005 Kucera et al.
2005/0123408 A1 6/2005 Koehl
2005/0191184 A1 9/2005 Vinson et al.
2005/0193485 A1 9/2005 Wolfe
2005/0196284 A1 9/2005 Gaudet et al.
2005/0226731 A1 10/2005 Mehlhorn et al.
2005/0260079 A1 11/2005 Allen
2006/0045750 A1 3/2006 Stiles
2006/0045751 A1 3/2006 Beckman et al.
2006/0045752 A1 3/2006 Beckman
2006/0090255 A1 5/2006 Cohen
2006/0112480 A1 6/2006 Sisk
2006/0127227 A1 6/2006 Mehlhorn et al.
2006/0132458 A1 6/2006 Garfio et al.
2007/0056955 A1 3/2007 Maddox
2007/0056956 A1 3/2007 Maddox
2007/0058313 A1 3/2007 Maddox
2007/0058314 A1 3/2007 Maddox
2007/0058315 A1 3/2007 Maddox
2007/0061051 A1 3/2007 Maddox
2007/0073236 A1 * 3/2007 Mernoe et al. ..... 604/151
2007/0114162 A1 5/2007 Stiles et al.
2007/0138290 A1 * 6/2007 Salvato ..... G06F 1/1622 235/462.44
2007/0154319 A1 * 7/2007 Stiles et al. ..... 417/42
2007/0154320 A1 7/2007 Stiles, Jr. et al.
2007/0154321 A1 7/2007 Stiles, Jr. et al.
2007/0154322 A1 7/2007 Stiles, Jr. et al.
2007/0154323 A1 7/2007 Stiles, Jr. et al.
2007/0163929 A1 7/2007 Stiles, Jr. et al.
2007/0183902 A1 8/2007 Stiles, Jr. et al.
2008/0003114 A1 1/2008 Levin et al.
2008/0013259 A1 * 1/2008 Barton et al. ..... 361/679
2008/0045904 A1 * 2/2008 Estes et al. ..... 604/152
2008/0048046 A1 2/2008 Wagner et al.

(56) References Cited

U.S. PATENT DOCUMENTS

| | | | | |
|---|---|---|---|---|
| 2008/0130910 | A1 | 6/2008 | Jobling et al. | |
| 2008/0180268 | A1* | 7/2008 | Nissels et al. | 340/693.5 |
| 2008/0213101 | A1 | 9/2008 | Stimpson et al. | |
| 2009/0038696 | A1 | 2/2009 | Levin et al. | |
| 2009/0069749 | A1* | 3/2009 | Miller et al. | 604/151 |
| 2009/0106890 | A1 | 4/2009 | Rosenau | |
| 2009/0132066 | A1 | 5/2009 | Hollaway | |
| 2009/0138587 | A1 | 5/2009 | Callaghan | |
| 2009/0185914 | A1 | 7/2009 | Elnar | |
| 2009/0200245 | A1 | 8/2009 | Steinbrueck et al. | |
| 2009/0241252 | A1 | 10/2009 | Li | |
| 2009/0255049 | A1 | 10/2009 | Rosenau | |
| 2009/0271921 | A1 | 11/2009 | Castellote | |
| 2009/0284108 | A1 | 11/2009 | Castellano et al. | |
| 2009/0320201 | A1 | 12/2009 | Wu | |
| 2010/0064428 | A1 | 3/2010 | Loyd et al. | |
| 2010/0092308 | A1 | 4/2010 | Stiles, Jr. et al. | |
| 2010/0097040 | A1 | 4/2010 | Boisvert et al. | |
| 2010/0138786 | A1 | 6/2010 | McQueen | |
| 2011/0091329 | A1 | 4/2011 | Stiles, Jr. et al. | |
| 2011/0213504 | A1 | 9/2011 | Cedrone et al. | |
| 2011/0228192 | A1 | 9/2011 | Hollaway | |
| 2011/0286859 | A1 | 11/2011 | Ortiz et al. | |
| 2012/0226383 | A1 | 9/2012 | Hollaway | |
| 2013/0027861 | A1 | 1/2013 | Rosenau et al. | |
| 2013/0129536 | A1 | 5/2013 | Robol et al. | |
| 2013/0180460 | A1 | 7/2013 | Stiles, Jr. et al. | |
| 2014/0027359 | A1 | 1/2014 | Stiles, Jr. et al. | |
| 2014/0064985 | A1 | 3/2014 | Stiles, Jr. et al. | |
| 2014/0205465 | A1 | 7/2014 | Stiles, Jr. et al. | |
| 2014/0314582 | A1 | 10/2014 | Stiles, Jr. et al. | |
| 2014/0363308 | A1 | 12/2014 | Stiles, Jr. et al. | |
| 2015/0030463 | A1 | 1/2015 | Stiles, Jr. et al. | |
| 2015/0204334 | A1 | 7/2015 | Stiles, Jr. et al. | |
| 2015/0211531 | A1 | 7/2015 | Stiles, Jr. et al. | |
| 2015/0300358 | A1 | 10/2015 | Stiles, Jr. et al. | |
| 2016/0061204 | A1 | 3/2016 | Stiles, Jr. et al. | |
| 2016/0153456 | A1 | 6/2016 | Stiles, Jr. et al. | |
| 2017/0114788 | A1 | 4/2017 | Stiles, Jr. et al. | |

FOREIGN PATENT DOCUMENTS

| | | | |
|---|---|---|---|
| CA | 2582175 | A1 | 3/2000 |
| CA | 2588584 | A1 | 3/2000 |
| CA | 2517040 | A1 | 2/2006 |
| CA | 2672410 | A1 | 6/2008 |
| CA | 2672459 | A1 | 6/2008 |
| DE | 3308862 | A1 | 9/1984 |
| DE | 19938490 | A1 | 3/2001 |
| EP | 0863278 | A2 | 9/1988 |
| EP | 0735273 | A1 | 10/1996 |
| EP | 1018347 | A2 | 7/2000 |
| EP | 1429034 | A2 | 6/2004 |
| EP | 1485613 | A1 | 12/2004 |
| EP | 1630422 | A2 | 3/2006 |
| EP | 2102503 | A2 | 9/2009 |
| EP | 2122171 | A2 | 11/2009 |
| EP | 2122172 | A2 | 11/2009 |
| EP | 2267415 | A2 | 12/2010 |
| EP | 2273125 | A2 | 1/2011 |
| WO | WO 92/13195 | | 8/1992 |
| WO | WO 98/36339 | | 8/1998 |
| WO | WO 98/59174 | | 12/1998 |
| WO | 08/073329 | A2 | 6/2008 |
| WO | 08/073330 | A2 | 6/2008 |
| WO | WO 2008/073413 | A2 | 6/2008 |
| WO | WO 2011/106530 | A1 | 9/2011 |
| WO | WO 2011/106557 | A1 | 9/2011 |

OTHER PUBLICATIONS

Pollock, Elissa Sard, "Unrecognized Peril? The Industry Responds to Spa and Pool Drain-Related Drownings", Aqua—The Business Magazine for Spa & Pool Professionals, Jul. 1996, pp. 63-64 (2 pages).

"Important Points to Know About CalSpas", brochure, pp. 1-11 (10 pages).

"Teel Vacuum Switch", Teel brochure, 1995, W.W. Granger, Inc., pp. 1-4 (4 pages).

"Rotary Gear Pumps and Vacuum-On Switch", Teel brochure, p. 1 (1 page).

Levin, Alan P, P.E., "Design and Development of a Safety Vacuum Release System", Proceedings of the 2007 ASME International Mechanical Engineering Congress and Exposition, Nov. 11-15, 2007, Seattle, Washington, pp. 1-8 (8 pages).

Brochure from A.O. Smith Electrical Products Company, Tipp City, Ohio, featuring eMod Motors (13 pgs.), and eMod Load Sensing Module Specification and Instruction Guide (2 pgs.), 2006.

Webpage from www.pentairpool.com comparing the IntelliFlo Pump and the IntelliFlo 4 X 160 Pump (1 pg.), and brochure for Pentair Pool Products for IntelliFlo 4 X 160 Pump (4 pgs.), 2006.

Restriction Requirement dated Dec. 23, 2009, from U.S. Appl. No. 11/601,588 (8 pages).

Office Action dated Sep. 13, 2010, from U.S. Appl. No. 11/601,588 (18 pages).

Office Action dated Apr. 1, 2010, from U.S. Appl. No. 11/601,588 (36 pages).

Notice of Allowance dated Dec. 29, 2010, from U.S. Appl. No. 11/601,588 (9 pages).

International Search Report of the International Searching Authority dated Apr. 18, 2011, issued in connection with International Patent Appln. No. PCT/US11/26116 (2 pages).

International Preliminary Report on Patentability and Written Opinion of the International Searching Authority dated Aug. 28, 2012 in connection with International Patent Appln. No. PCT/US11/26116 (6 pages).

International Search Report of the International Searching Authority dated Apr. 29, 2011, issued in connection with International Patent Appln. No. PCT/US11/26082 (2 pages).

International Preliminary Report on Patentability and Written Opinion of the International Searching Authority dated Aug. 28, 2012 in connection with International Patent Appln. No. PCT/US11/26082 (6 pages).

Restriction Requirement dated Oct. 18, 2013, from U.S. Appl. No. 13/034,542 (7 pages).

Notice of Allowance dated Jan. 22, 2014, from U.S. Appl. No. 13/034,542 (16 pages).

Declaration Under 37 C.F.R. 1.132 of Jason W. Parcell dated Jul. 18, 2017 (6 pages).

Abb, "Drive IT Low Voltage AC Drives, User's Manual ACH550-01 Drives, ACH550-UH Drives," dated Dec. 17, 2003 (435 pages).

Allen-Bradley, "1336 Plus II Adjustable Frequency AC Drive with Sensorless Vector, User Manual," Rockwell Automation, dated Sep. 2005 (211 pages).

Cliff Wyatt, "Monitoring Pumps," World Pumps, www.worldpumps.com, dated Dec. 2004 (5 pages).

Danfoss Graham, "Siemens Floor Level Network; VLT® 6000 Adjustable Frequency Drive Instruction Manual," dated Feb. 2000 (32 pages).

Danfoss, "Instruction Manual, Cascade Controller Option, VLT® 6000 HVAC, VLT® 8000 AQUA," dated Jan. 11, 2006 (68 pages).

Danfoss, "Salt Drive Systems: Increase oil & gas production, Minimize energy consumption," dated Dec. 2011 (16 pages).

Danfoss, "VLT® 4000 VT Instruction Manual," dated Oct. 14, 2005 (142 pages).

Danfoss, VLT® 4000, 5000, 6000, 8000 Service Manual, dated Feb. 2006 (157 pages).

Danfoss, "VLT® Series Drives Service Manual," copyright 2002 (68 pages).

Danfoss, "Application Option VLT® 5000 ," dated May 29, 2006 (34 pages).

Danfoss, "VLT® 5000 Crane, Operating Instructions," dated Feb. 1, 2005 (123 pages).

Danfoss, "VLT® 5000 Flux, Operating Instructions," dated Nov. 3, 2005 (163 pages).

(56) References Cited

OTHER PUBLICATIONS

Danfoss, "VLT® 5000 Series Instruction Manual," dated Dec. 12, 2006 (238 pages).
Danfoss, "VLT® 6000 Instruction Manual," dated Feb. 2006 (126 pages).
Danfoss, "VLT® 6000 Series LonWorks® Option Card Instruction Manual," LonWorks, dated May 2003 (44 pages).
Danfoss, "VLT® 8000 AQUA Instruction Manual," dated Apr. 16, 2004 (210 pages).
Danfoss, "VLT® 8000 AQUA Series Designed for Water/Wastewaster Applications," dated Jan. 2002 (2 pages).
Danfoss, "VLT® Series 3500 Adjustable Frequency Drive Instruction Manual," copyright 1995 (123 pages).
Danfoss, "VLT® 5000 Profthus to FC 302 Converter, VLT® AutomationDrive FC 300," dated Sep. 24, 2008 (64 pages).
Danfoss, "VLT® 5000, VLT® 6000 HVAC, VLT® 8000 AQUA, Instruction Manual," LonWorks FTP, dated Mar. 22, 2004 (46 pages).
Danfoss, "Danfoss, VLT® 6000 Series Adjustable Frequency Drive Installation, Operation and Maintenance Manual," dated Mar. 2000, pp. 1-118 (118 pages).
Danfoss, "VLT® 8000 Aqua" Instruction Manual, Polish language, dated Aug. 12, 2003 (173 pages).
Danfoss, "VLT® Aqua Drive—The Ultimate solution for Water, Wasetwater & Irrigation," dated 2008 (16 page).
Goldline Controls, "AQUA PLUS Automation and Chlorination, Installation Manual for model AQL-PLUS, AQL-PLUS-20," copyright 2008 (36 pages).
Goldline Controls, Inc. "PRO LOGIC™ Automation and Chlorination, Installation Manual for model PL-P-4," copyright 2008 (18 pages).
Goldline Controls, Inc., "AQUA LOGIC Automation and Chlorination Installation Manual for model AQL-P-4," www.goldlinecontrols.com, copyright 2005 (35 pages).
Goldline Controls, Inc., "AQUA LOGIC Automation and Chlorination Installation Manual for models AQL-PS-4, AQL-PS-8, AQL-PS-16," copyright 2006 (22 pages).
Goulds Pumps/G&L Pumps, "Variable Speed Product Line," ITT Industries, dated Jul. 2003 (4 pages).
Goulds, "AQUAVAR® CPC Centrifugal Pump Controller, Quick Start Guide," dated Nov. 2004 (2 pages).
Hayward®, "Pro Logic® Automation and Chlorination, Installation Manual for model PL-P-4," copyright 2010 (18 pages).
Load Controls Incorporated, Product web pages including Affidavit of Christopher Butler of Internet Archive attesting to the authenticity of the web pages, http://web.archive.org/web/20030812134011/http://www.loadcontrols.com/products/products.html, webpage archived Aug. 12, 2003 (20 pages).
Pentair Water Pool and Spam™, "IntelliFlo® 4/160 and 4/100 Variable Speed Programmable Pump . . . Installation and User's Guide," dated Feb. 15, 2006 (40 pages).
Pentair Water Pool and Spa™, "IntelliFlo® Variable Speed Programmable Pump . . . Installation and User's Guide," dated Jul. 26, 2011 (52 pages).
Pentair Water Pool and Spa™, "IntelliFlo® Variable Speed Pump . . . Installation and User's Guide," dated Dec. 29, 2005 (64 pages).
Schneider Electric, "Variable Speed Drives Altivar 71," dated Mar. 2005 (215 pages).
Square D Company, "Altivar® 66 AC Drives, Enclosed AC Drives, Motor Control Centers, Class 8800/ 8839/ 8998," dated Oct. 1994 (156 pages).
Trane®, "TR1™ Series VFD Variable Frequency Drives," TR1-SLB005-EN, dated Oct. 2003 (24 pages).
Wen Technology, Inc., "Unipower® HPL 110 Digital Power Monitor Installation and Operation" copyright 1999 (20 pages).
112-Amended Complaint Against All Defendants, with Exhibits; filed in Civil Action 5:11-cv-00459D on Jan. 17, 2012 (143 pages).
54DX16-Hayward EcoStar Technical Guide (Version2); pp. 1-51; cited in Civil Action 5:11-cv-00459D on Dec. 2, 2011 (51 pages).
54DX38-Danfoss; "VLT® 6000 Series Installation, Operation & Maintenance Manual;" dated Mar. 2000; pp. 1-76; cited in Civil Action 5:11-cv-00459D on Dec. 2, 2011 (77 pages).
9PX16-Hayward Pool Products; "EcoStar Owner's Manual (Rev. B);" Copyright 2010; pp. 1-32; Elizabeth. NJ; cited in Civil Action 5:11-cv-00459D on Sep. 30, 2011 (32 pages).
9PX17-Hayward Pool Products; "EcoStar & EcoStar SVRS Brochure;" Copyright 2010; pp. 1-7; Elizabeth, NJ; cited in Civil Action 5:11-cv-00459D on Sep. 30, 2011 (7 pages).
9PX23-Hayward Pool Products; Selected Pages from Hayward's Website www.hayward-pool.com; pp. 1-27; cited in Civil Action 5:11-cv-00459D on Sep. 30, 2011 (27 pages).
9PX28-Hayward Pool Products; Selected Page from Hayward's Website Relating to EcoStar Pumps; p. 1: cited in Civil Action 5:11-cv-00459D on Sep. 30, 2011 (2 pages).
9PX29-Hayward Pool Products: Selected Page from Hayward's Website Relating to EcoStar SVRS Pumps; cited in Civil Action 5:11-cv-00459 on Sep. 30, 2011 (2 pages).
9PX-42-Hayward Pool Systems; "Hayward EcoStar & EcoStar SVRS Variable Speed Pumps;" Copyright 2010; civil Action 5:11-cv-00459D (7 pages).
Grundfos; "CU301 installation & Operating instructions;" dated Sep. 22, 2005; pp. 1-30 (31 pages).
Danfoss, "Modbus Plus—VLT® 5000 Series Modbus Plus Option Card Installation & Operation Manual," undated (65 pages).
Danfoss, VLT® AQUA Drive, "The ultimate solution for Water, Wastewater, & Irrigation", dated May 2010 (36 pages).
Jandy®, "Installation and Operation Manual—ePump™ Series Pumps," copyright 2009 (28 pages).
Sta-Rite®, "IntelliPro™ 4x160 and 4x100 Four Speed Variable Centrifugal Pump with Integral Trap," Rev A, dated Oct. 18, 2006 (44 pages).
Danfoss, "VLT® 8000 AQUA," french language, dated Feb. 2002 (178 pages).
G&L Pumps, "AQUAVAR® CPC (Centrifugal Pump Control) Installation and Operation Manual," dated Jul. 2004 (164 pages).
G&L Pumps, "AQUAVAR® CPC," dated Jun. 2004 (8 pages).
Danfoss, VLT® 8000 AQUA, "VLT® 8000 AQUA Operating and Instructions Software Version: 1.3x," MG.80.A6.02 (undated, known about at least as early as Nov. 11, 2011) (192 pages).
Danfoss, VLT® 8000 AQUA, "VLT® 8000 AQUA Operation Instructions Software version: 1.7x," MG.83.A2.02 (undated, known about at least as early as Nov. 11, 2011) (206 pages).
Danfoss, "Cascade Controller Option for VLT® 6000 HVAC and VLT® 8000 AQUA Operating Instructions Software version: 2.x," MG.60.I5.02 (undated, known about at least as early as Nov. 11, 2011) (63 pages).
Danfoss, "VLT® 6000 HVAC," MG.60.C8.02 (undated, known about at least as early as Nov. 11, 2011) (28 pages).
Danfoss, VLT® 6000 HVAC Series, "VLT(11) 6000 HVAC Design Guide Software Version: 3.0x," MG.61.B4.02 (undated, known about at least as early as Nov. 11, 2011) (216 pages).
Danfoss, VLT® 6000 HVAC Series, "VLT® 6000 HVAC Operating Instructions Software version: 3.0x," MG.61.A5.02 (undated, known about at least as early as Nov. 11, 2011) (170 pages).
Pentair Water Pool and Spa, Jeff Farlow, "Maximizing Profits and Energy Efficiency available through Green Alternatives" (Cover page states Long Island—Dec. 16, 2008) (15 pages).
H2Flow Pool & Spa Products Division, "Eco-Flow-C Variable Frequency Drive for Commercial Swimming Pools & Water Feature Pumps Product Brochure" dated Sep. 2010 (7 pages).
Pentair Water Commercial Pool and Aquatics™, "Commercial Acu Driven™ XS Variable Frequency Drive," Copyright 2008 (4 pages).
Danfoss, "VLT® 8000 AQUA Operating Instructions," dated Mar. 14, 2006 (210 pages).
Danfoss, "VLT® AQUA Drive—The Ultimate solution for Water, Wasetwater & Irrigation," dated May 2007 (16 page).
U.S. Appl. No. 14/665,958 (downloaded from the USPTO Public Air database on Sep. 18, 2017) (434 pages).
Extended European Search Report dated Mar. 28, 2018, issued by the European Patent Office in connection with European Patent Application No. EP11748069.9 [National Stage of WO 2011/106530] (8 pages).

(56) References Cited

OTHER PUBLICATIONS

Pentair Pool Products®, "MasterTemp™ Pool and Spa Heater 120/240 Vac Natural Gas/LP Gas, Installation and User's Guide," dated Apr. 4, 2006 (38 Pages).

* cited by examiner

UNIVERSAL MOUNT FOR A VARIABLE SPEED PUMP DRIVE USER INTERFACE

CROSS-REFERENCE TO RELATED APPLICATION

This application claims the benefit of U.S. Provisional Patent Application No. 61/308,241 filed Feb. 25, 2010, the disclosure of which is incorporated herein by reference in its entirety.

TECHNICAL FIELD

The present disclosure relates to an universal mount, and more particularly, to an universal mount for a variable speed pump drive user interface.

BACKGROUND

Various controllers have, in the past, been developed for pools. One example is a controller that controls a variable speed pump and automatically adjusts the speed of the pump based on operating conditions. The controller typically includes a user interface (e.g., keypad) for allowing a user to interact with a stored control program for controlling the variable speed pump. Some of these user interfaces are mounted to the pump in only one orientation. Other user interfaces are mounted remotely from the pump.

Pumps must adapt to the specific configuration of an existing fluid circulation system. For example, a return line of the fluid circulation system (which is typically connected to a pump, directly or indirectly) could be positioned in a particular direction, and therefore, the outlet of the pump must be aligned with the return line accordingly. As a result, the pump could be oriented in such a manner that a user could have difficultly accessing the interface.

Accordingly, it would be desirable for an user to easily access the user interface regardless of the orientation of the pump.

SUMMARY

Disclosed herein are systems and methods for universally mounting a user interface for a combination variable speed pump and a drive assembly therefor. In some aspects, the user interface is universally configured to be selectively mounted to (i) the drive assembly, and/or (ii) an environmental surface such as the outside wall of a house. In some aspects, the user interface is universally configured to be selectively mounted to the drive assembly in any one of a plurality of available positions relative thereto, and, in this regard, the user interface can be selectively oriented at the pump by a user to enhance physical access of the user to the interface at the location at which the combination is positioned.

The present disclosure relates to a variable speed pumping system. More particularly, the variable speed pumping system includes a pumping assembly that includes at least a pump, a motor, and a drive assembly. The pumping assembly has a mount, and a user interface selectively positionable among a plurality of positions with respect to the mount.

In an exemplary embodiment, the variable speed pumping assembly includes a pump, a variable speed motor in communication with the pump, and a drive assembly sized to control the variable speed motor. A user interface is selectively positionable among a plurality of positions with respect to the pump, variable speed motor, and/or the drive assembly.

A method is disclosed for selectively positioning a user interface relative to a pumping assembly that includes at least a pump, a motor, and a drive assembly. The method includes the steps of mounting the user interface to the pumping assembly in a first position, and moving the user interface to a second position with respect to the pumping assembly. The second position is different from the first position.

BRIEF DESCRIPTION OF THE DRAWINGS

For a more complete understanding of the present disclosure, reference is made to the following Detailed Description of the Exemplary Embodiment(s), considered in conjunction with the accompanying drawings, in which.

DETAILED DESCRIPTION OF EXEMPLARY EMBODIMENT(S)

Figure 1:
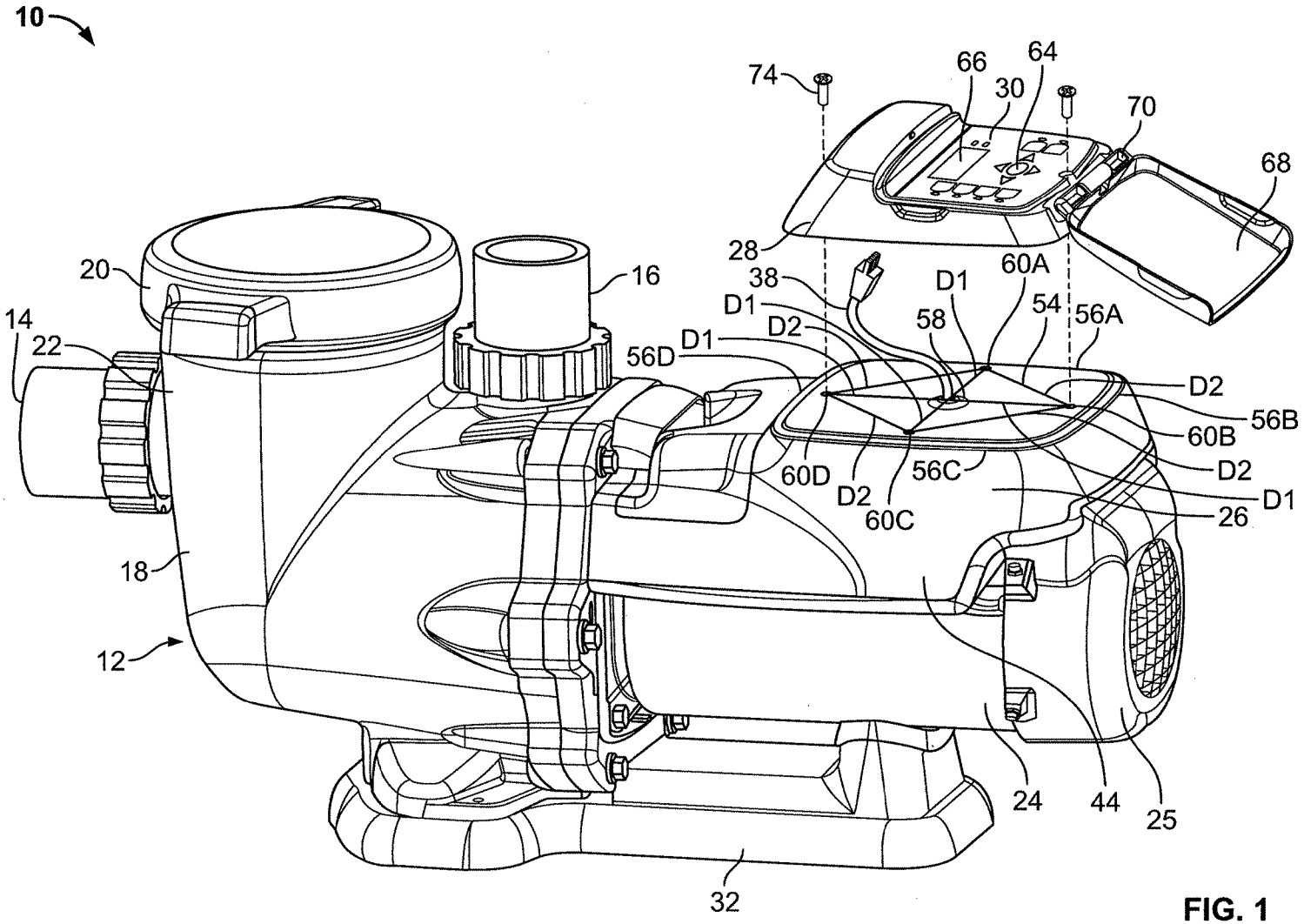
FIG. 1 is a partially exploded perspective view of a variable speed pumping system, the variable speed pumping system including a variable speed pumping assembly that includes a variable speed pump, a motor for the variable speed pump, a drive assembly for the motor, and a user interface module for the drive assembly.

Referring to FIG. 1, a variable speed pumping system 10 is provided for connection to a fluid circulation line of a swimming pool and/or other recreational body of water, such as a spa, etc. The variable speed pumping system 10 is typically connected to the fluid circulation line so as to pump dirty water therethrough and return clean water thereto. Other devices might be connected along the fluid circulation line, such as sand filters, chlorinators, and other devices known in the art.

The variable speed pumping system 10 could be provided with structures and functions known in the art. As a non-limiting example, reference is made to the TriStar Energy Solution® Variable Speed Pump and Control of Hayward Industries, Inc., Elizabeth, N.J.

The variable speed pumping system 10 includes a variable speed pumping assembly that has a variable speed pump 12 which has an inlet 14 for receiving fluid from the fluid circulation line and an outlet 16 for discharging fluid to the fluid connection line. The variable speed pump 12 includes a strainer chamber 18 positioned between the inlet 14 and the outlet 16. The strainer chamber 18 includes a strainer basket (not shown) for filtering water that flows into the inlet 14. A circular cover 20 is secured to a top end 22 of the strainer chamber 18.

Figure 2:
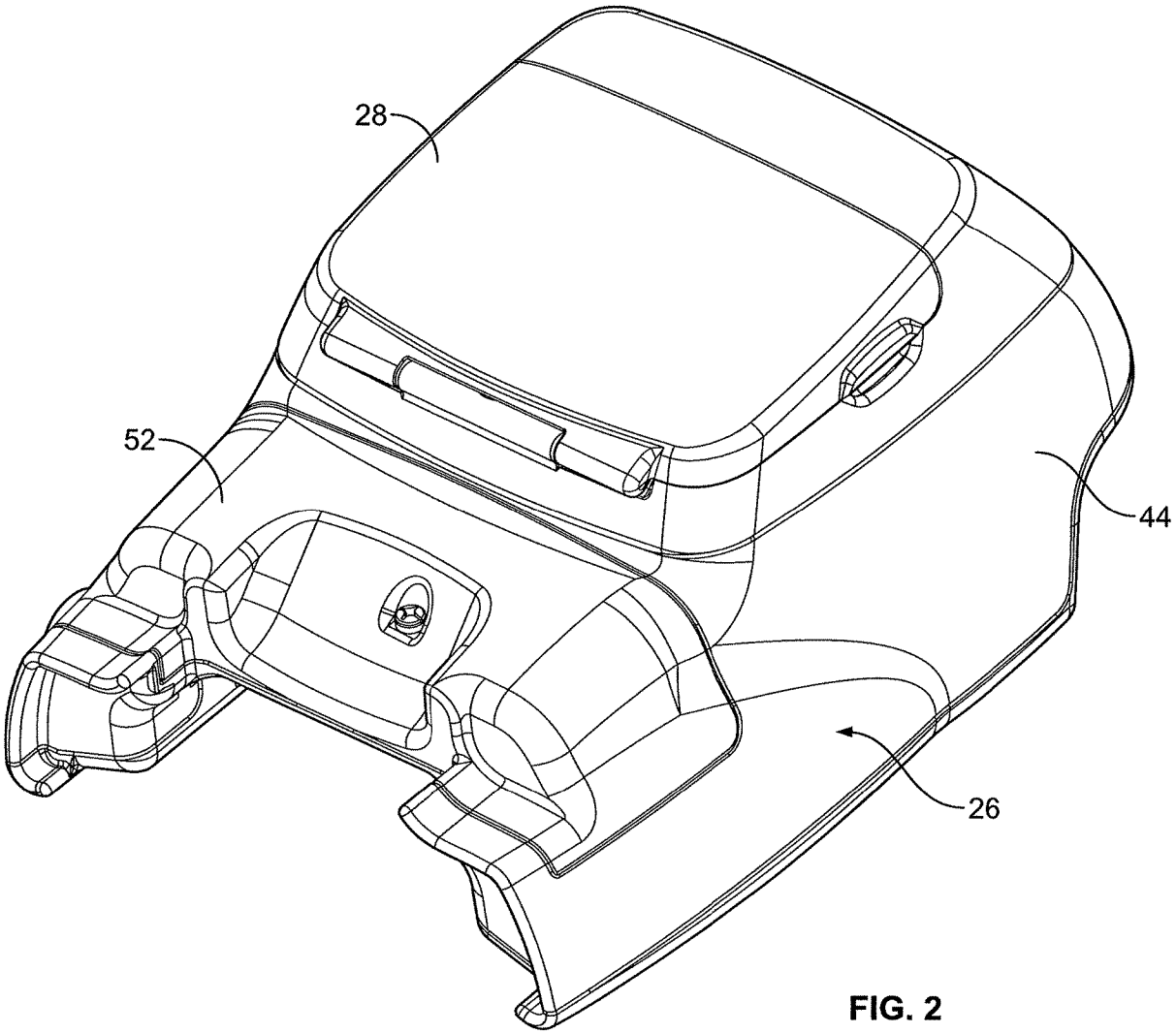
FIG. 2 is a perspective view of the drive assembly shown in FIG. 1.

The variable speed pumping assembly further includes a variable speed motor 24 to drive the variable speed pump 12, and a drive assembly 26 (FIG. 2) to variably control the speed of the motor 24. A fan shroud 25 is provided to cover one end of the motor 24. An interface module 28 with a user interface control panel 30 is provided in electrical communication with the drive assembly 26 for user input of parameters, as will be explained in further detail hereinafter.

The motor 24 is connected to the strainer chamber 18, and drives an impeller to pump fluids from the inlet 14, through the strainer chamber 18, and out the outlet 16. The drive assembly 26 is situated on top of the motor 24. A base 32 is positioned under the strainer chamber 18 and the motor 24 to provide stability and mounting.

Figure 3:
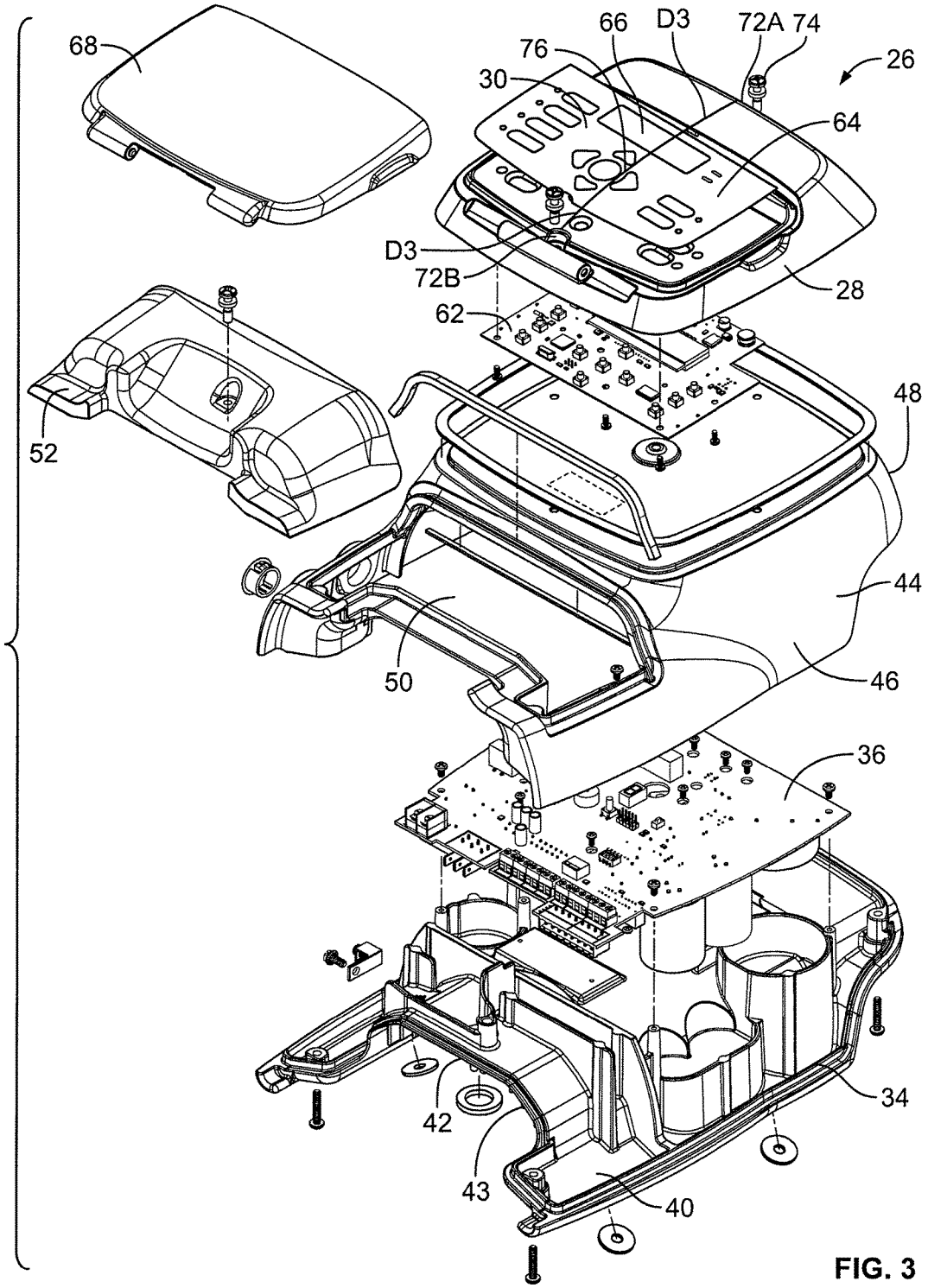
FIG. 3 is an exploded view of the drive assembly shown in FIG. 1.

With reference to FIG. 3, the drive assembly 26 includes an enclosure 34 that contains the electrical components, such as a main printed circuit board 36 and a controller with a processor, for driving the motor 24. An electrical cable 38 (FIG. 1) is connected to the electrical components. The enclosure 34 includes a peripheral portion 40 and an interior portion 42 that is elevated relative to the peripheral portion 40. The bottom of the drive assembly 26 includes a heat sink 43 (see FIGS. 11, 12, and 14-16) configured to allow heat to be properly dissipated away from the electrical components. The heat sink 43 could be made from any suitable material, such as a thermally conductive and electrically insulative material.

The drive assembly 26 further includes a housing 44 positioned over the enclosure 34. The housing 44 has side walls 46 and a rear wall 48. The housing 44 has an opening 50 for allowing access to the electrical components situated in the enclosure 34. A wiring compartment cover 52 is provided to close off the opening 50 formed in the housing 44.

Referring to FIG. 1, the housing 44 has a top 54 that is substantially planar, and has four peripheral edges 56A-D, which cooperate to form a substantially square shape. Opposing peripheral edges are generally planar and parallel to each other. While the top 54 of the housing 44 is shown as having a substantially square shape, the top 54 of the housing 44 could have other shapes, e.g., circular, etc.

A center opening 58 is formed through the top 54 of the housing 44 of the drive assembly 26 to allow the electrical cable 38 to extend therethrough, and a plurality of apertures 60A-D is formed in the top 54 of the housing 44 for reasons to be described hereinafter. The apertures 60A-D are positioned at substantially the same distance from the center opening 58. In particular, a first aperture 60A is spaced a predetermined distance D1 from the opening 58 along the horizontal axis. A second aperture 60B is spaced substantially the same predetermined distance D1 from the opening 58. Likewise, a third aperture 60C is spaced substantially the same predetermined distance D1 from the opening 58. A fourth aperture 60D is spaced substantially the same predetermined distance D1 from the opening 58. In this manner, the distance between each aperture 60A, 60B, 60C, or 60D and the center opening 58 is substantially the same.

Additionally, adjacent apertures 60A-B, 60B-C, 60C-D, or 60D-A are positioned substantially equidistance from each other. In particular, the first aperture 60A is spaced substantially a predetermined distance D2 from the second aperture 60B. The second aperture 60B is spaced substantially the same predetermined distance D2 from the third aperture 60C. Likewise, the third aperture 60C is spaced substantially the same predetermined distance D2 from the fourth aperture 60D. The fourth aperture 60D is spaced substantially a predetermined distance D2 from the first aperture 60A. While the apertures 60A-D could be formed in various locations on the drive assembly 44, the apertures 60A-D shown in FIG. 1 are formed along the circumference of a circle.

It will be understood that while four apertures 60A-D are shown, the number of apertures could vary. Likewise, the distance between each adjacent aperture 60A-B, 60B-C, 60C-D, or 60D-A need not be identical, and the distance between each aperture 60A, 60B, 60C, or 60D and the center opening 58 need not be identical.

The interface module 28 is detachably secured relative to the drive assembly 26. In particular, the interface module 28 could be fastened to an exterior surface of the drive assembly 26, such as the top 54 of the housing 44 of the drive assembly 26. In this manner, the top 54 of the housing 44 of the drive assembly 26 serves as an universal mount for the interface module 28. It will be understood that the universal mount for the interface module 28 could be any exterior surface of the pump 12, the motor 24, or any other surface of the variable speed pumping system 10.

The interface module 28 contains the user interface control panel 30 and electrical components, such as an interface display printed circuit board 62 (FIG. 3). The user interface control panel 30 has a keypad 64 and a display 66 that provides information from the electrical components. The keypad 64 can include push buttons or a flat panel membrane for allowing a user to provide input, such as selecting menu options (for speed, time, etc.), answers, and/or values, etc. These quantities can be shown on the display 66, such as an LCD display. The electrical cable 38 connects the interface module 28 to the electrical components stored in the enclosure 34. The interface module 28 can receive descriptive or indicative information from the electrical components.

Figure 4:
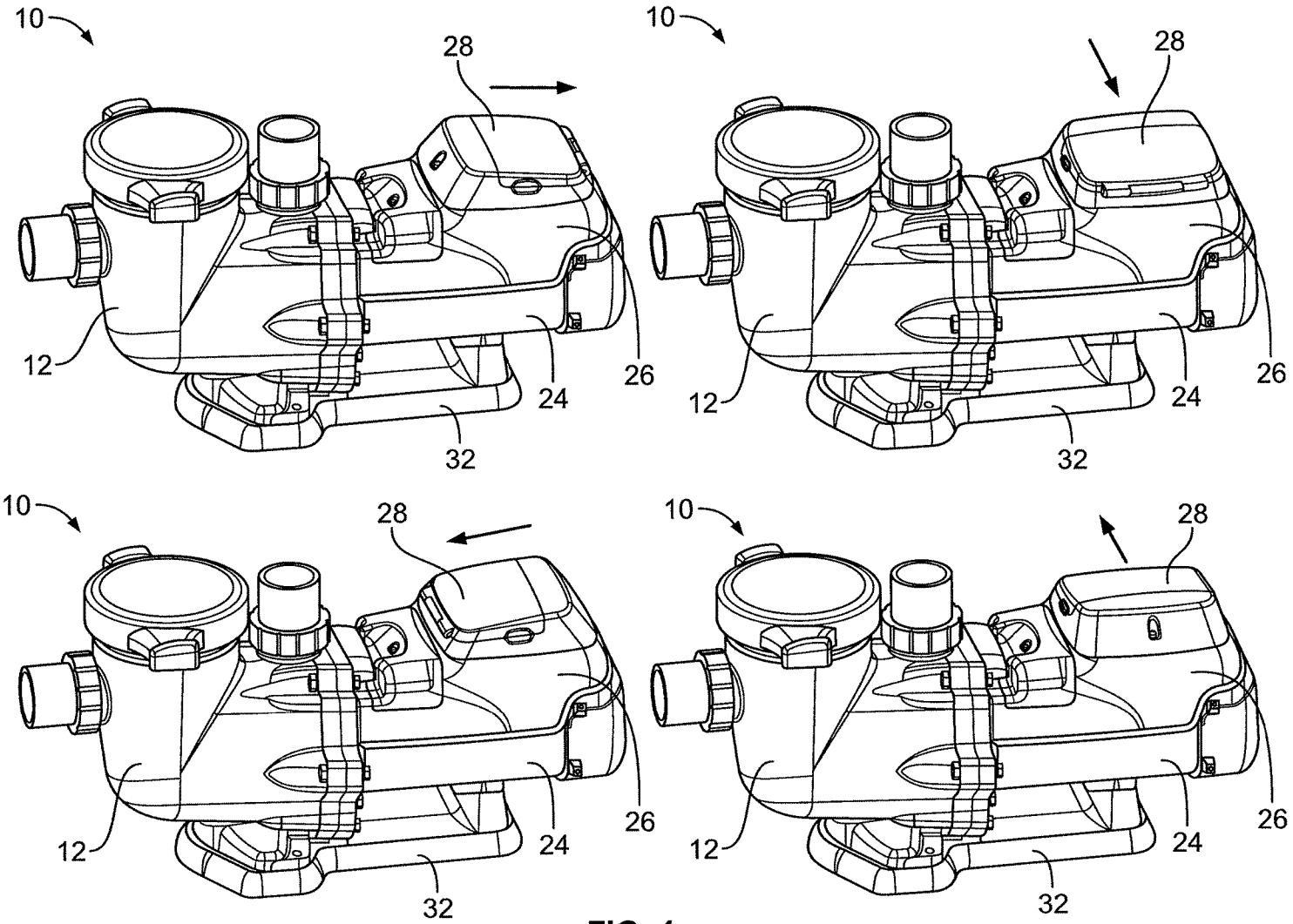
FIG. 4 shows four perspective views of the variable speed pumping system shown in FIG. 1, showing the interface module in four different positions relative to the drive assembly.

An interface cover 68 is provided to selectively cover the interface module 28. Living hinges 70 are provided for pivotally connecting the interface cover 68 to the interface module 28 such that the interface cover 68 is pivotable between a closed or retracted position, in which the interface cover 68 is positioned over the user interface control panel 30 (as shown in FIG. 4), and an unfolded or extended position, in which the interface cover 68 projects away from the user interface control panel 30 to allow access to the user interface control panel 30 (as shown in FIG. 1).

Referring to FIG. 3, the interface module 28 is shown having a substantially square shape, however, the interface module 28 could have other shapes, e.g., circular, etc. The interface module 28 includes a plurality of apertures 72A-B that are aligned with the apertures 60A-D (FIG. 1) of the housing 44, thereby enabling the interface module 28 to be removeably secured to the housing 44 by fastening means, such as screws 74.

The apertures 72A-B formed in the interface module 28 are positioned at substantially the same distance from a center 76 of the interface module 28. In particular, a first aperture 72A is spaced substantially a predetermined distance D3 from the center 76 along the horizontal axis. A second aperture 72B is spaced substantially the same predetermined distance D3 from the center 76. In this manner, the distance between each aperture 72A or 72B and the center 76 is substantially the same.

It will be understood that while two apertures 72A-B are shown, the number of apertures could vary. Likewise, the distance between each aperture 72A or 72B and the center 76 need not be identical.

In an exemplary embodiment, the interface module 28 is assembled to the drive assembly 26 with the panel retaining screws 74. The use of other mechanical locking systems to fasten the interface module 28 to the drive assembly 26 is contemplated. If the user decides to change the orientation of the interface module 28 relative to the drive assembly 26, the screws 74 are removed, the interface module 28 is rotated to a desired orientation, such as any of the orientations shown in FIG. 4, and the interface module 28 is secured to the drive assembly 26 in the desired orientation with the screws 74. The electrical cable 38 is of sufficient length to allow communication between the interface module 28 and the drive assembly 26 regardless of the orientation of the interface module 28 relative to the drive assembly 26.

In one embodiment, the orientation of the interface module 28 could be changed relative to the drive assembly 26 without removing the interface module 28 from the drive assembly 26. For example, the interface module 28 could be configured on a rotatable turret.

In view of the configuration of the apertures and the shapes of the interface module 28 and the top 54 of the housing 44 of the drive assembly 26, the interface module 28 could be selectively positionable relative to the drive assembly 26. In one embodiment, the interface module 28 could be selectively positionable relative to the drive assembly 26 about a vertical axis. As a result, the interface module 28 could be simply installed in any direction on the drive assembly 26.

Figure 6:
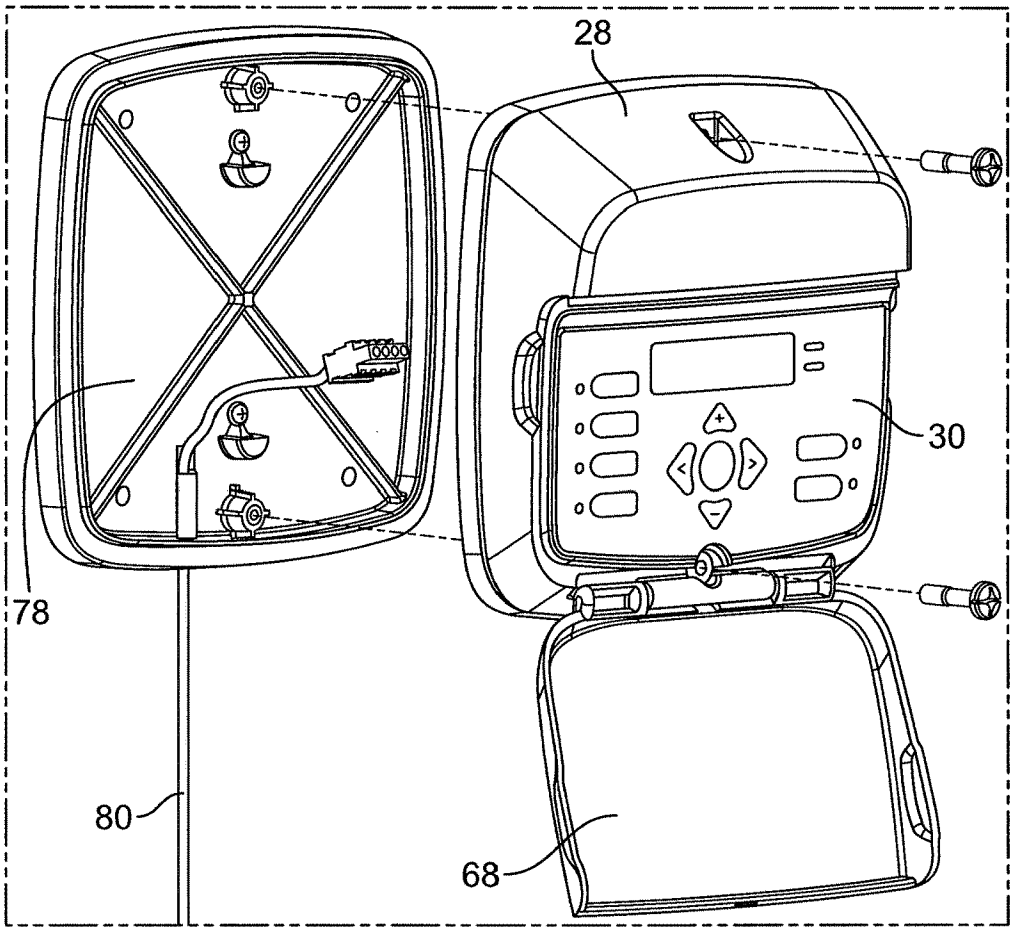
FIG. 6 is an exploded view of the interface module and a mounting bracket.
Figure 5:
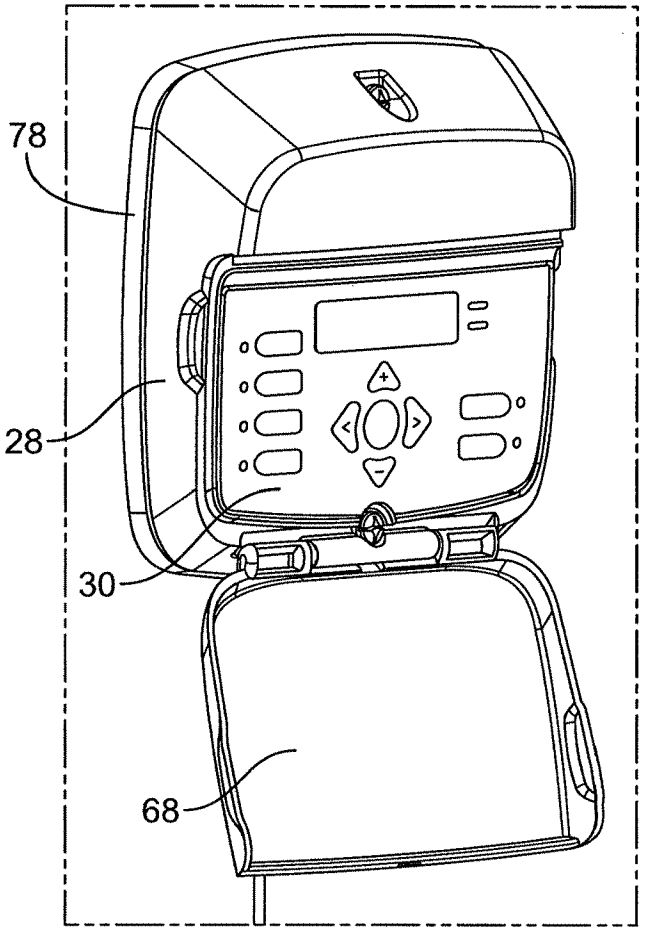
FIG. 5 is a front view of the interface module shown in FIG. 1 mounted at a location remote from the drive assembly.

With reference to FIGS. 5 and 6, the interface module 28 could be mounted remotely from the drive assembly 26, such as in any location (for example, a vertical wall) within the vicinity of a pool. The interface module 28 is removed from the drive assembly 26, and the communication cable 38 is disconnected from the interface module 28. A mounting bracket 78 could be secured at the remote location for use in mounting the interface module 28. A communication data cable 80, such as a six-wire data cable, is connected to the drive assembly 26, routed through an opening formed in the drive assembly 26, through a channel formed in the mounting bracket 78, and is then connected to the interface module 28. In one embodiment, the remotely positioned interface module 28 is in communication with the electrical components through a wireless connection.

Figure 7:
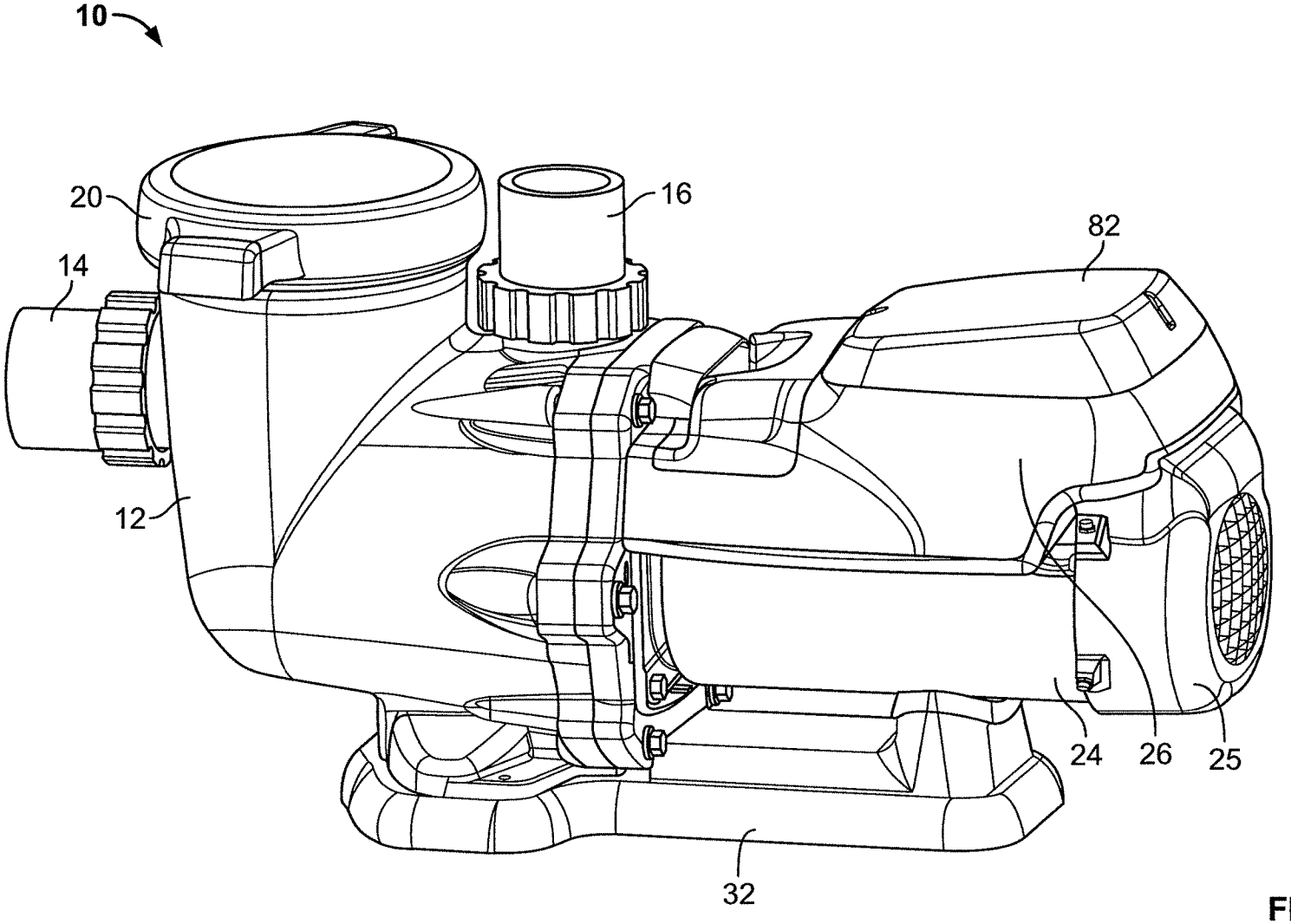
FIG. 7 is a perspective view of the variable speed pumping system shown in FIG. 1, showing a blank cover over the drive assembly.
Figure 8:
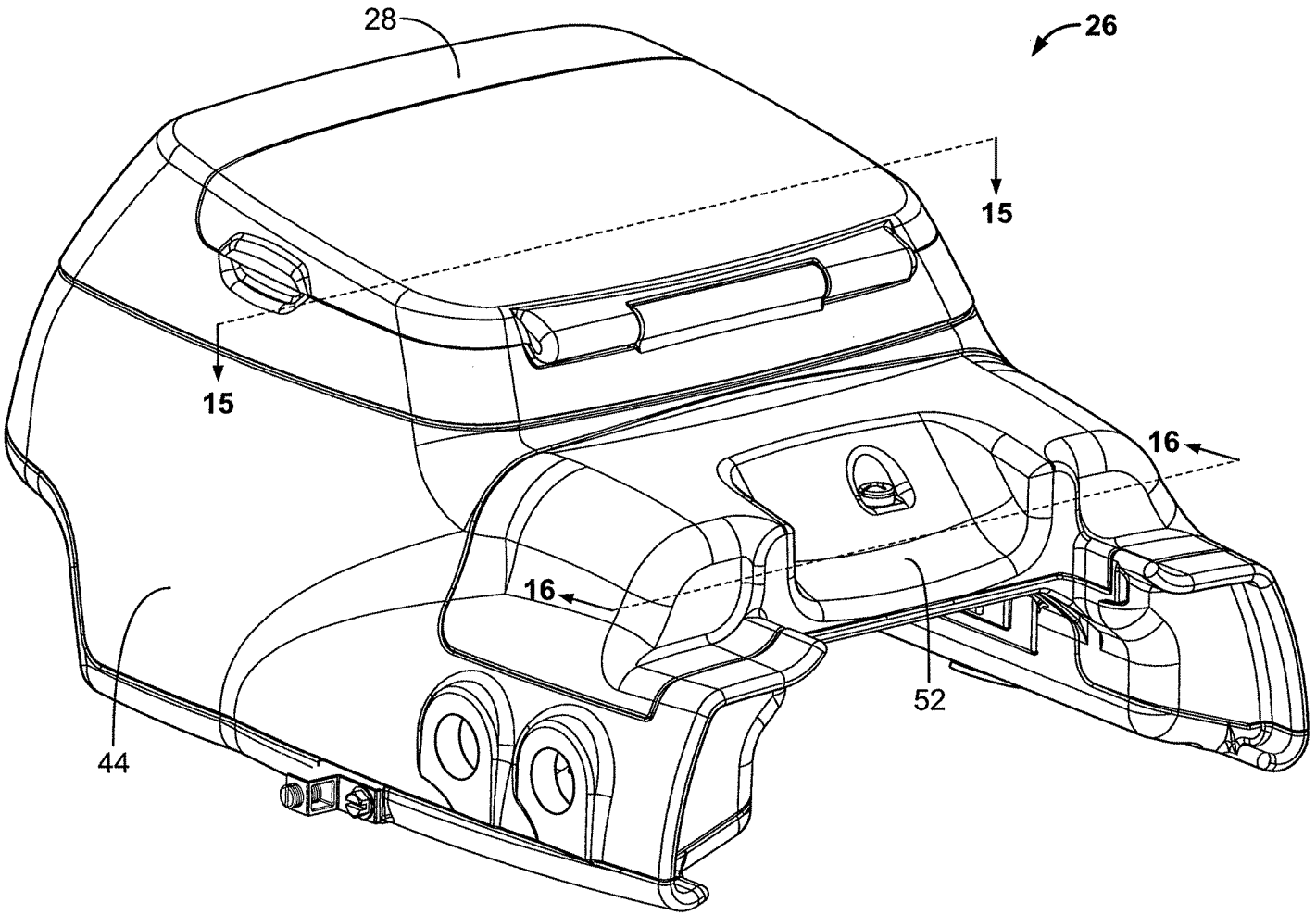
FIG. 8 is a perspective view of the drive assembly shown in FIG. 1.
Figure 9:
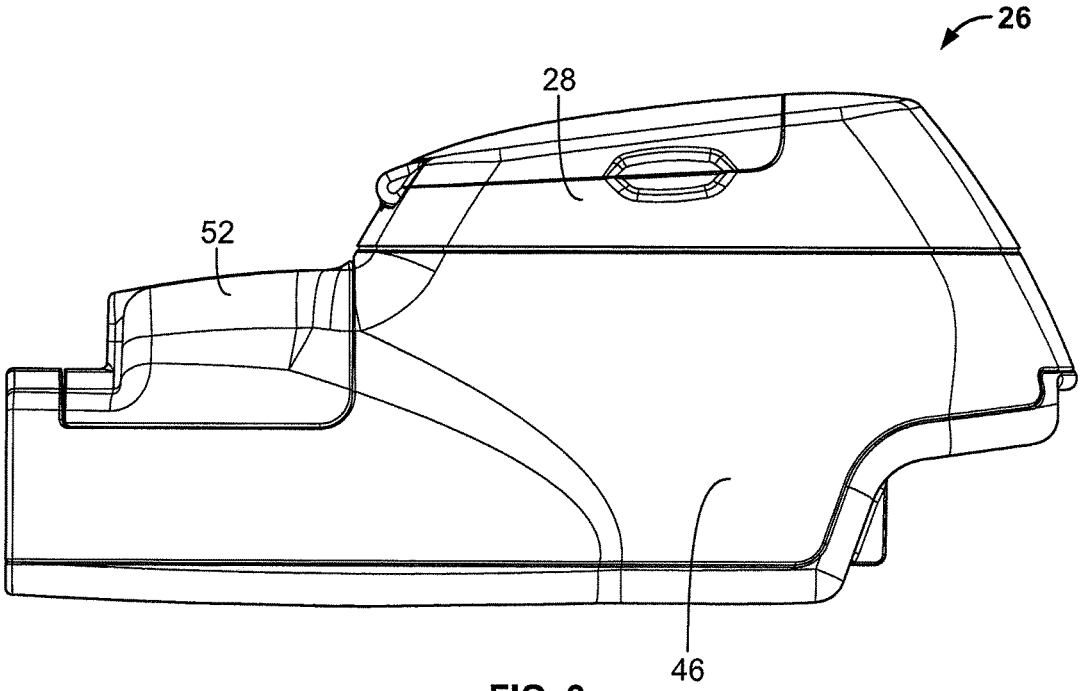
FIGS. 9 and 10 are side views of the drive assembly shown in FIG. 1.
Figure 10:
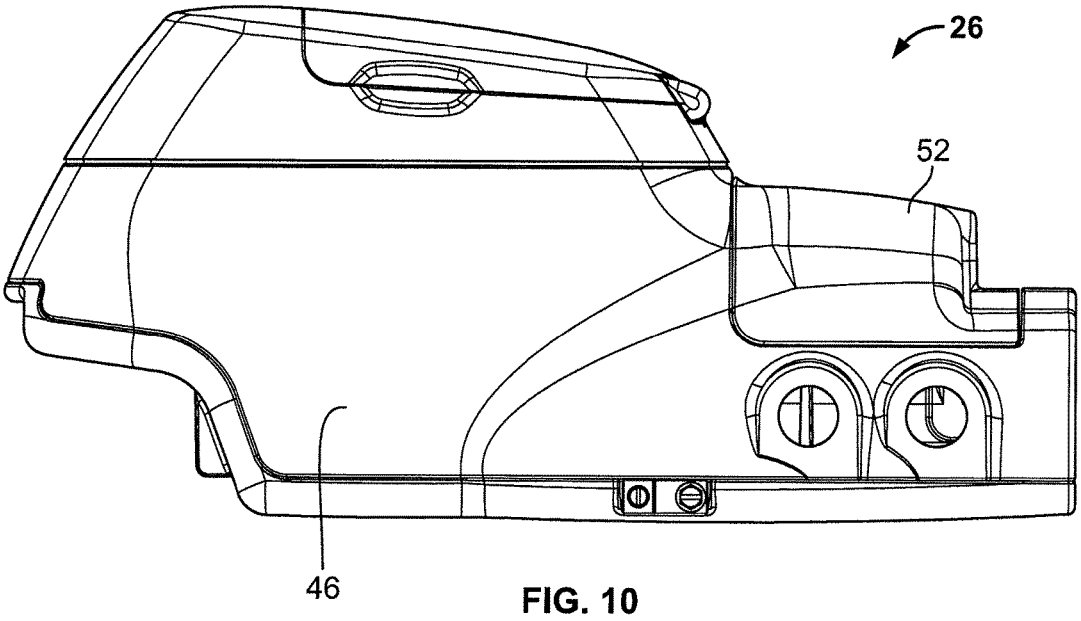
Figure 11:
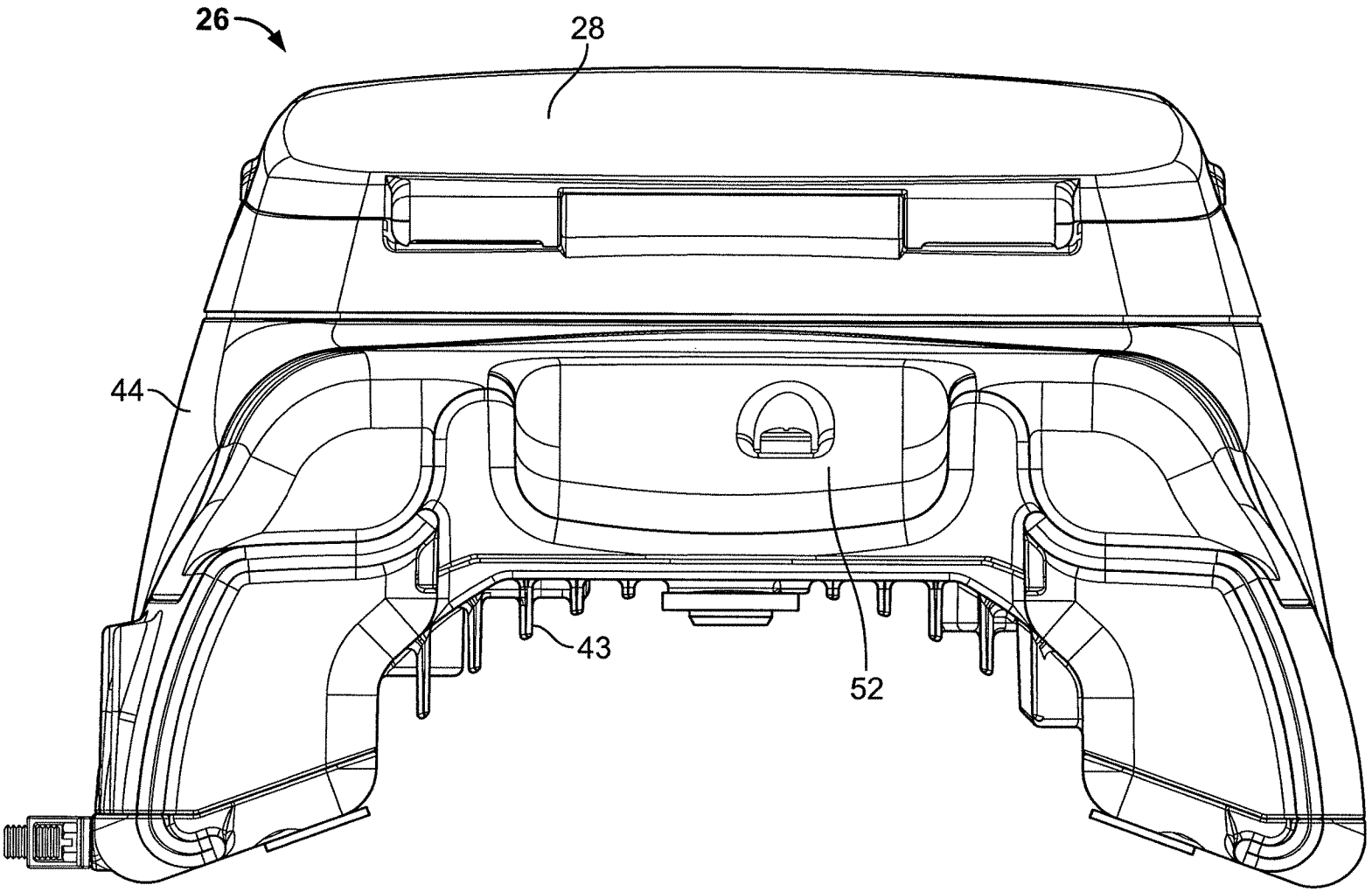
FIGS. 11-14 are views of the drive assembly shown in FIG. 1.
Figure 12:
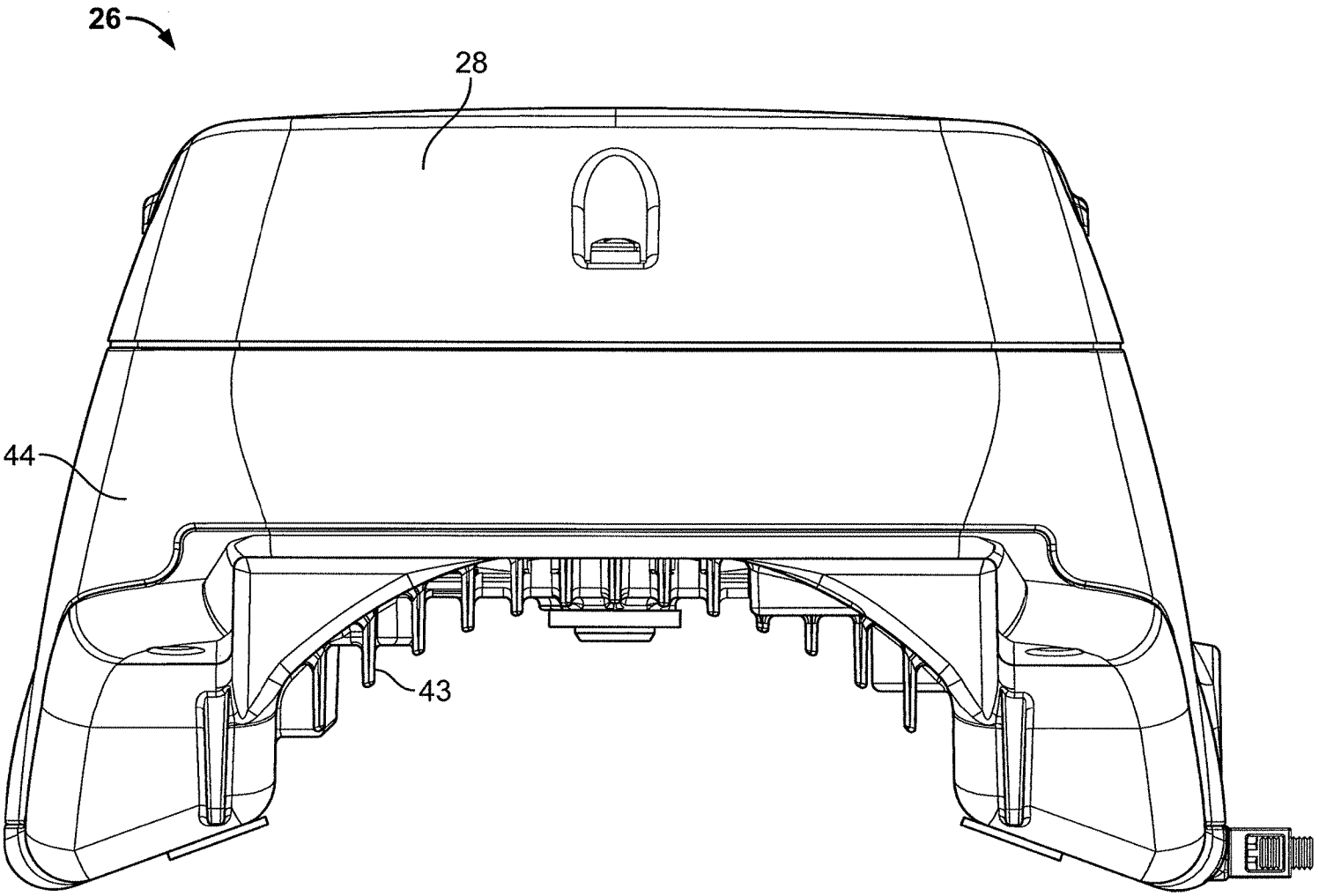
Figure 13:
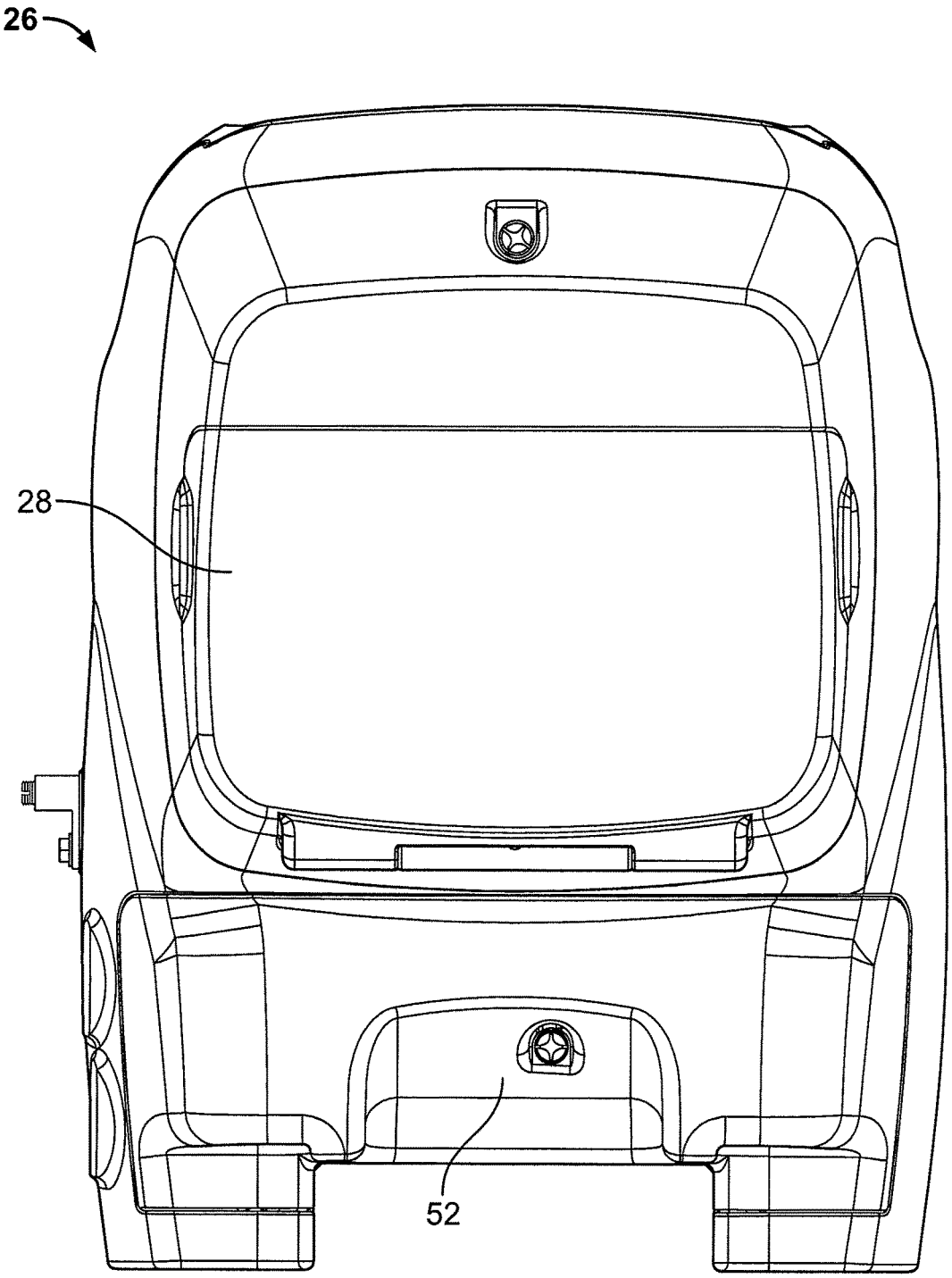
Figure 14:
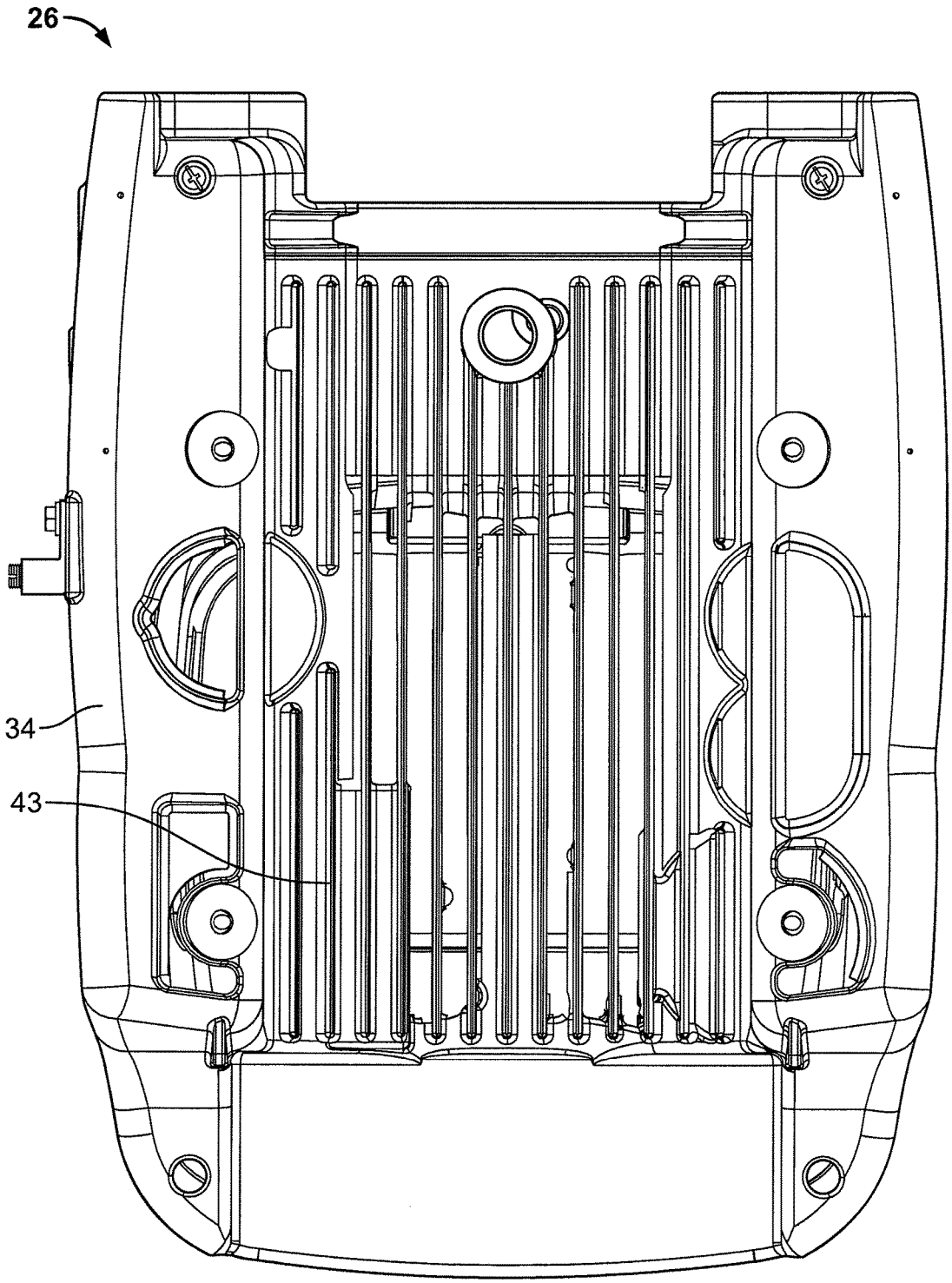
Figure 15:
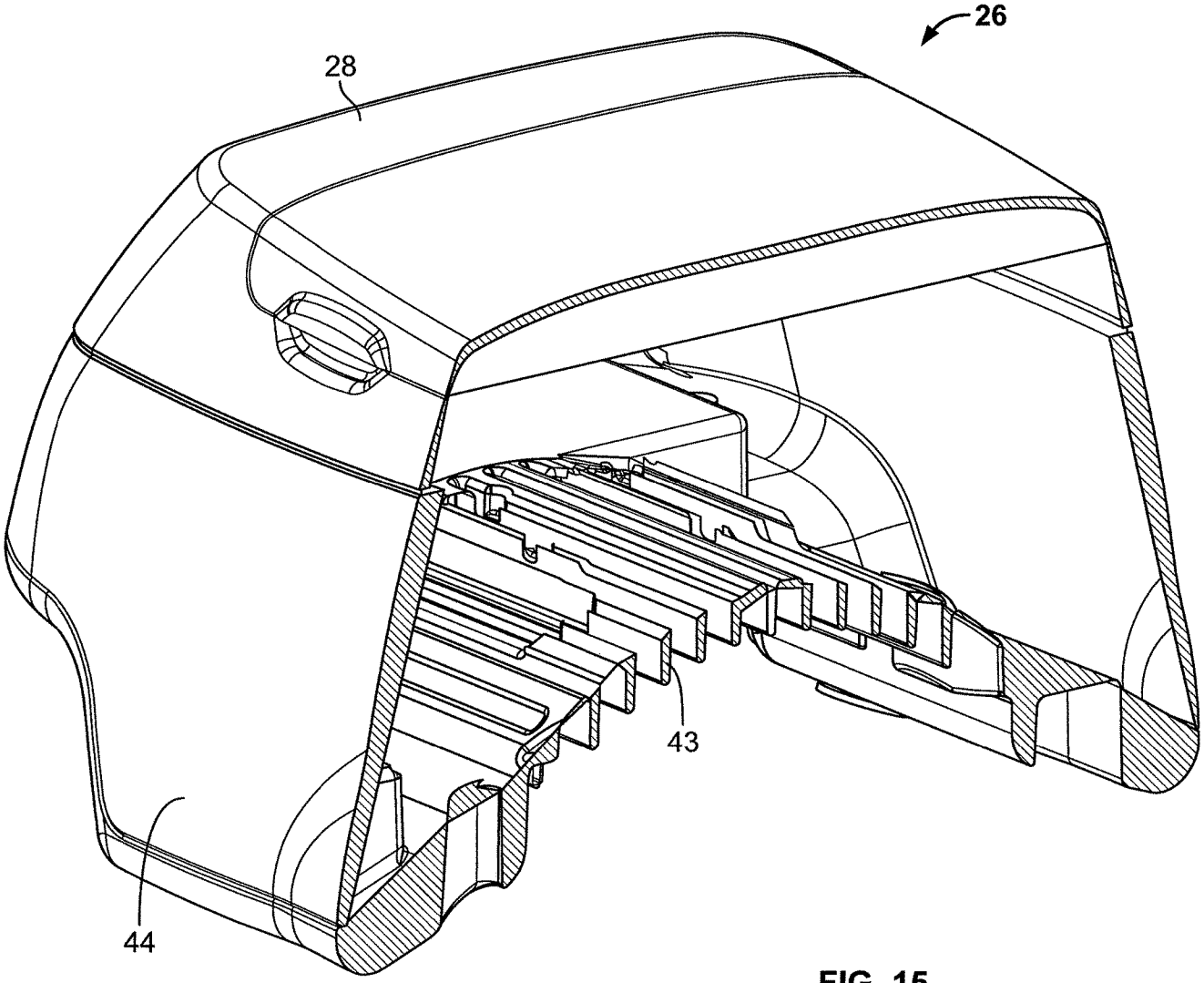
FIG. 15 is a cross-sectional line view, taken along section lines 15-15 and looking in the direction of the arrows, of the drive assembly shown in FIG. 8.
Figure 16:
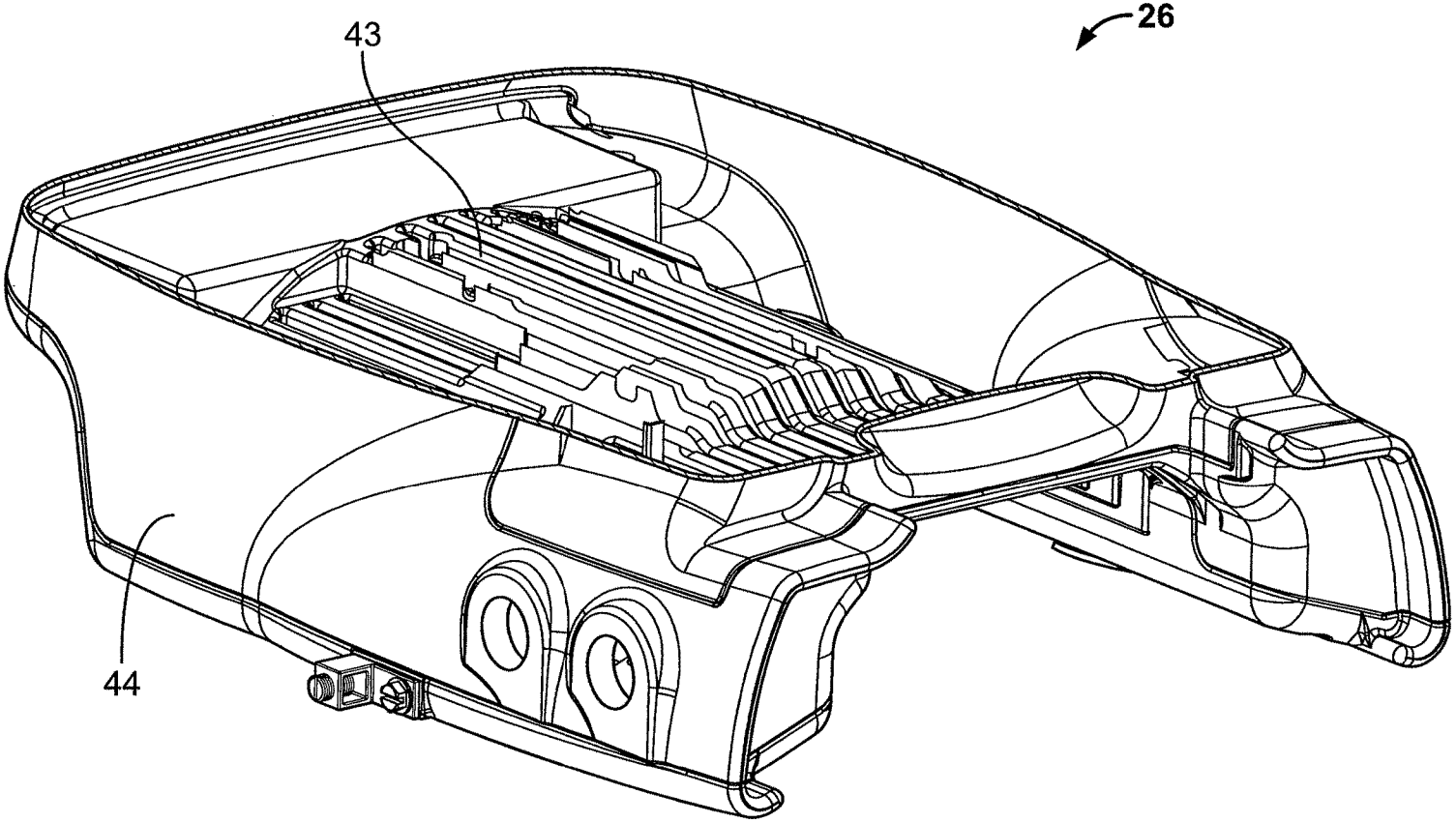
FIG. 16 is a cross-sectional line view, taken along section lines 16-16 and looking in the direction of the arrows, of the drive assembly shown in FIG. 8.
Figure 17:
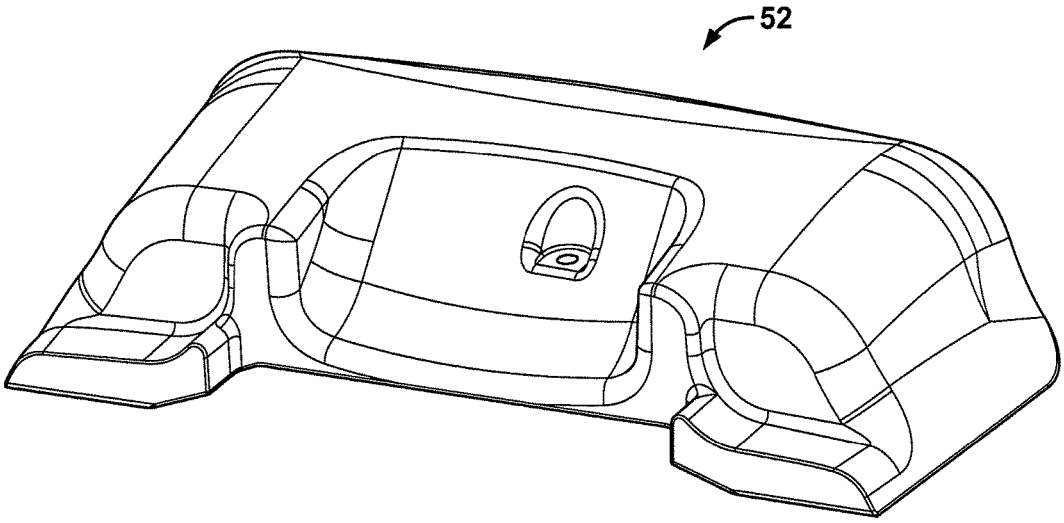
FIG. 17 is a perspective view of a wiring compartment cover for the drive assembly shown in FIG. 1.
Figure 18:
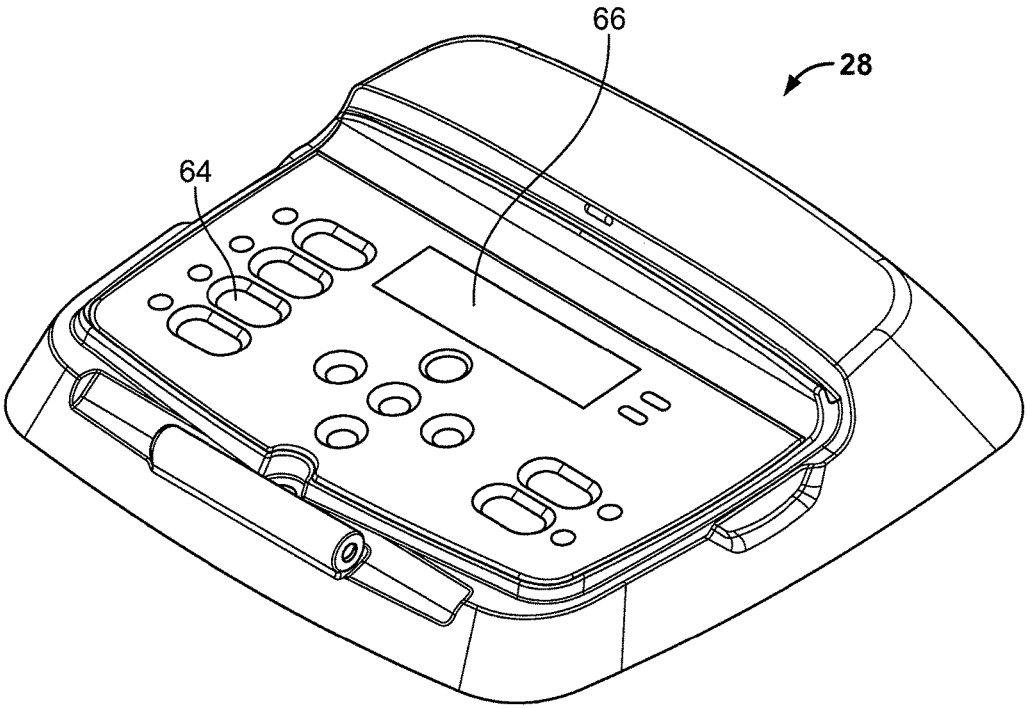
FIG. 18 is a perspective view of the interface module shown in FIG. 1.
Figure 19:
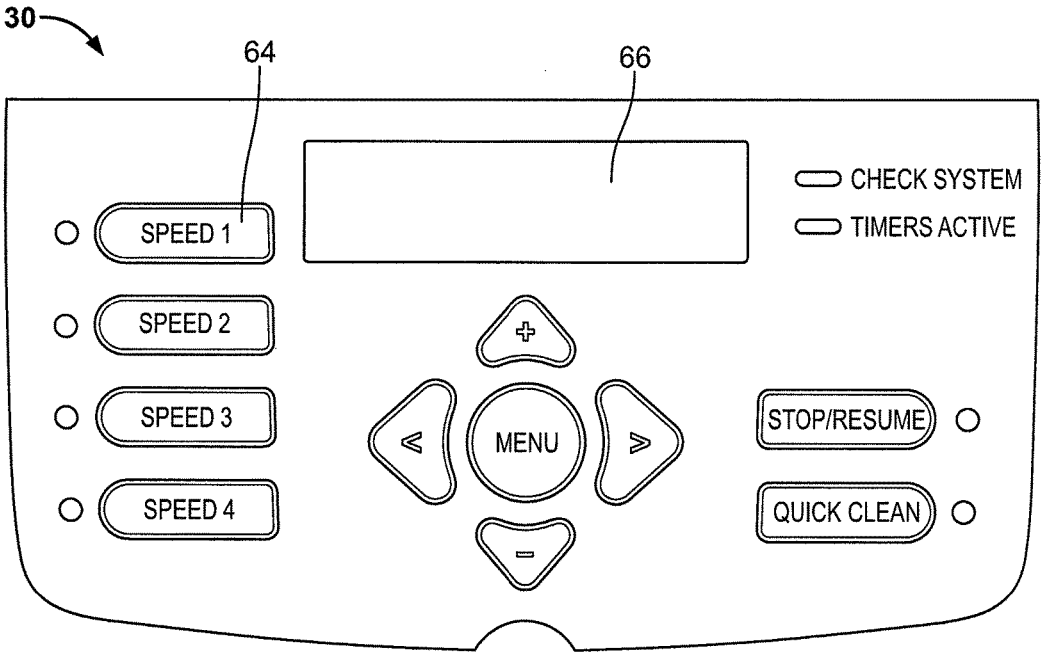
FIG. 19 is a top view of an user interface control panel shown in FIG. 1.
Figure 20:
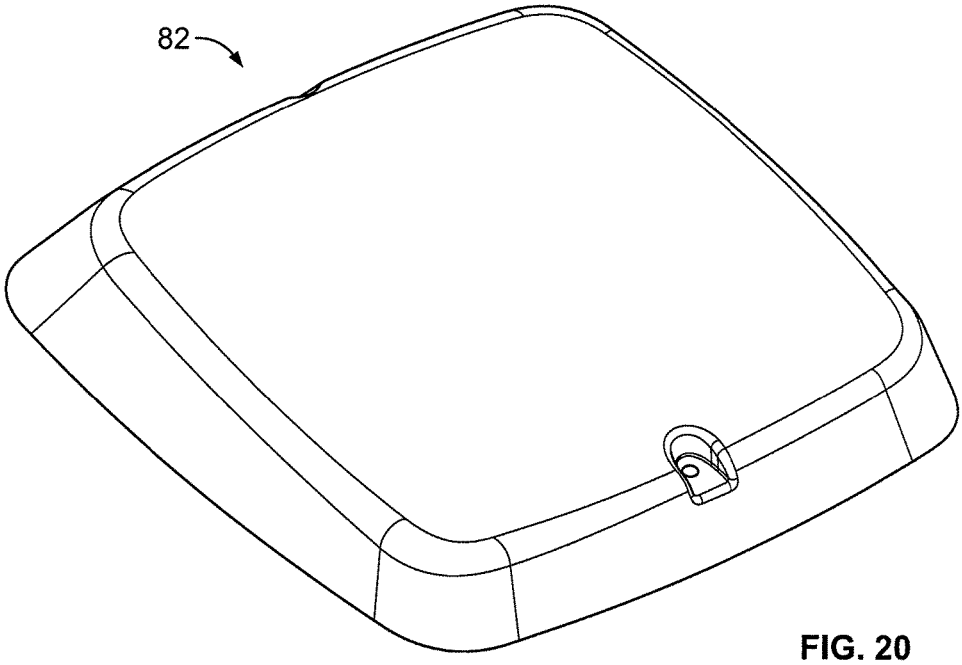
FIG. 20 is a perspective view of the blank cover shown in FIG. 7.

A blank cover 82 (see FIG. 7) could be positioned over the drive assembly 26 when the interface module 28 is remotely mounted. The blank cover 82 is used to protect the communication cable 38.

It will be understood that the embodiments described herein are merely exemplary and that a person skilled in the art may make many variations and modifications without departing from the spirit and scope of the disclosure. All such variations and modifications are intended to be included within the scope of the disclosure as defined by the appended claims.

What is claimed is:

1. A variable speed pumping system comprising: a pumping assembly including at least a pump, a motor, and a drive assembly, said pumping assembly having a mount including a plurality of mount apertures and a center point positioned generally equidistant from each of said plurality of mount apertures, each of said plurality of mount apertures positioned generally equidistant from adjacent mount apertures; and a user interface, having a display with user input means for selecting an operating parameter of the motor, a plurality of interface apertures, and a center point positioned generally equidistant from each of said plurality of interface apertures, said user interface, including said plurality of interface apertures and including said display with user input means for selecting an operating parameter of the motor, selectively positionable among a plurality of positions with respect to said mount to allow the user interface having the user input means to be removably installed in any of said plurality of positions on said mount, each of said plurality of positions is along a substantially horizontal plane about a substantially vertical axis on said mount with the plurality of interface apertures aligned with the plurality of mount apertures; wherein said plurality of positions includes a first position, a second position, a third position, and a fourth position, said user interface selectively positionable between said first position, said second position, said third position, and said fourth position on said pumping assembly.

2. The variable speed pumping system of claim 1, wherein said drive assembly includes said mount.

3. The variable speed pumping system of claim 2, wherein said mount is an exterior surface of said drive assembly.

4. The variable speed pumping system of claim 2, wherein said drive assembly is secured to the motor.

5. The variable speed pumping system of claim 1, wherein said plurality of mount apertures include adjacent pairs of apertures, one of said adjacent pairs of said plurality of mount apertures is positioned generally equidistant from another of said adjacent pairs of said plurality of mount apertures.

6. The variable speed pumping system of claim 1, wherein said plurality of mount apertures is aligned with said plurality of interface apertures when said user interface is vertically aligned with said mount.

7. The variable speed pumping system of claim 1, wherein one end of said user interface is positionable on one end of said mount and an opposite end of said user interface is positionable on an opposite end of said mount in one of said plurality of positions, and wherein said one end of said user interface is positionable on said opposite end of said mount and said opposite end of said user interface is positionable on said one end of said mount in another of said plurality of positions.

8. The variable speed pumping system of claim 1, wherein the pumping assembly includes an inlet for receiving fluid from a fluid circulation line and an outlet for discharging fluid to the fluid circulation line.

9. The variable speed pumping system of claim 8, further comprising a strainer chamber positioned between the inlet and the outlet.

10. The variable speed pumping system of claim 9, further comprising a strainer basket positioned in the strainer chamber for filtering fluid that flows through the strainer chamber.

11. The variable speed pumping system of claim 10, further comprising a strainer chamber cover secured to a top end of the strainer chamber.

12. The variable speed pumping system of claim 11, wherein the motor is connected to the strainer chamber and includes an impeller, the motor being configured to drive the impeller to pump fluid from the inlet, through the strainer chamber, and out of the outlet.

13. The variable speed pumping system of claim 1, wherein the motor includes an impeller, the motor being configured to drive the impeller to pump fluid through the pumping assembly.

14. The variable speed pumping system of claim 1, wherein the motor is a variable speed motor.

15. The variable speed pumping system of claim 1, further comprising a base, the motor being mounted to the base.

16. The variable speed pumping system of claim 1, wherein the drive assembly contains a printed circuit board and a controller for driving the motor.

17. The variable speed pumping system of claim 16, further comprising an electrical cable in electrical communication with the controller, the electrical cable configured to be connected to the user interface.

18. The variable speed pumping system of claim 17, wherein the user interface receives information from the controller.

19. The variable speed pumping system of claim 1, wherein the drive assembly includes a housing having a top that has a substantially square shape, and the user interface has a substantially square shape, the shape of the user interface substantially matching the shape of the top of the housing.

20. The variable speed pumping system of claim 1, wherein the drive assembly includes a heat sink.

21. The variable speed pumping system of claim 20, wherein the heat sink is made of a thermally conductive and electrically insulative material.

22. The variable speed pumping system of claim 1, wherein the display is an LCD display.

23. The variable speed pumping system of claim 1, wherein the user input means is a keypad.

24. The variable speed pumping system of claim 23, wherein the keypad includes at least one push button or a flat panel membrane allowing a user to provide input.

25. The variable speed pumping system of claim 1, wherein the user input means allows a user to input a motor speed.

26. The variable speed pumping system of claim 1, wherein the user interface includes an interface cover.

27. The variable speed pumping system of claim 26, wherein the interface cover is pivotably mounted to the user interface, the interface cover being pivotable between a closed position covering the user input means and display, and an open position exposing the user input means and display.

28. The variable speed pumping system of claim 1, wherein the plurality of mount apertures includes a first mount aperture, a second mount aperture, a third mount aperture, and a fourth mount aperture, the first mount aperture being spaced a first predetermined distance from the second mount aperture, the second mount aperture being spaced substantially the first predetermined distance from the third mount aperture, the third mount aperture being spaced substantially the first predetermined distance from the fourth mount aperture, and the fourth mount aperture being spaced substantially the first predetermined distance from the first mount aperture.

29. The variable speed pumping system of claim 28, wherein the plurality of interface apertures includes a first interface aperture and a second interface aperture, the first interface aperture being spaced substantially a second predetermined distance from the center point of the user interface, the second interface aperture being spaced substantially the second predetermined distance from the center point of the user interface.

30. The variable speed pumping system of claim 1, wherein the user interface is removably secured to the mount by a fastening means.

31. The variable speed pumping system of claim 30, wherein the fastening means is a screw.

32. The variable speed pumping system of claim 1, wherein the user interface is configured to be removed from the mount and mounted remotely from the drive assembly.

33. A variable speed pumping assembly comprising: a pump; a variable speed motor in communication with said pump; a drive assembly sized to control said variable speed motor and including a plurality of drive assembly apertures and a center point positioned generally equidistant from each of said plurality of drive assembly apertures, each of said plurality of drive assembly apertures positioned generally equidistant from adjacent drive assembly apertures; and a user interface having a display with user input means for selecting an operating parameter of the motor, a plurality of interface apertures, and a center point positioned generally equidistant from each of said plurality of interface apertures, said user interface, including said plurality of interface apertures and including said display with user input means for selecting an operating parameter of the motor, selectively positionable among a plurality of positions with respect to-said drive assembly to allow the user interface having the user input means to be removably installed in any of said plurality of positions on said drive assembly, each of said plurality of positions is along a substantially horizontal plane about a substantially vertical axis on said drive assembly with the plurality of interface apertures aligned with the plurality of drive assembly apertures; wherein said plurality of positions includes a first horizontal position, a second horizontal position, a third horizontal position, and a fourth horizontal position, said user interface selectively positionable between said first horizontal position, said second horizontal position, said third horizontal position, and said fourth horizontal position on said drive assembly.

34. The variable speed pumping assembly of claim 33, wherein said user interface is selectively positionable among a plurality of positions on said drive assembly.

35. The variable speed pumping assembly of claim 33, wherein said plurality of drive assembly apertures include adjacent pairs of apertures, one of said adjacent pair of said plurality of drive assembly apertures is positioned generally equidistant from another of said adjacent pair of said plurality of drive assembly apertures.

36. The variable speed pumping assembly of claim 33, wherein one end of said user interface is positionable on one end of said drive assembly and an opposite end of said user interface is positionable on an opposite end of said drive assembly in one of said plurality of positions, and wherein said one end of said user interface is positionable on said opposite end of said drive assembly and said opposite end of said user interface is positionable on said one end of said drive assembly in another of said plurality of positions.

37. The variable speed pumping assembly of claim 33, wherein said drive assembly is secured to the variable speed motor.

38. The variable speed pumping assembly of claim 33, wherein the pump includes an inlet for receiving fluid from a fluid circulation line and an outlet for discharging fluid to the fluid circulation line.

39. The variable speed pumping assembly of claim 38, further comprising a strainer chamber positioned between the inlet and the outlet.

40. The variable speed pumping assembly of claim 39, further comprising a strainer basket positioned in the strainer chamber for filtering fluid that flows through the strainer chamber.

41. The variable speed pumping assembly of claim 40, further comprising a strainer chamber cover secured to a top end of the strainer chamber.

42. The variable speed pumping assembly of claim 41, wherein the variable speed motor is connected to the strainer chamber and includes an impeller, the variable speed motor being configured to drive the impeller to pump fluid from the inlet, through the strainer chamber, and out of the outlet.

43. The variable speed pumping assembly of claim 33, wherein the variable speed motor includes an impeller, the motor being configured to drive the impeller to pump fluid through the pump.

44. The variable speed pumping assembly of claim 33, further comprising a base, the variable speed motor being mounted to the base.

45. The variable speed pumping assembly of claim 33, wherein the drive assembly contains a printed circuit board and a controller for driving the variable speed motor.

46. The variable speed pumping assembly of claim 45, further comprising an electrical cable in electrical communication with the controller, the electrical cable configured to be connected to the user interface.

47. The variable speed pumping assembly of claim 46, wherein the user interface receives information from the controller.

48. The variable speed pumping assembly of claim 33, wherein the drive assembly includes a housing having a top that has a substantially square shape, and the user interface has a substantially square shape, the shape of the user interface substantially matching the shape of the top of the housing.

49. The variable speed pumping assembly of claim 33, wherein the drive assembly includes a heat sink.

50. The variable speed pumping assembly of claim 49, wherein the heat sink is made of a thermally conductive and electrically insulative material.

51. The variable speed pumping assembly of claim 33, wherein the display is an LCD display.

52. The variable speed pumping assembly of claim 33, wherein the user input means is a keypad.

53. The variable speed pumping assembly of claim 52, wherein the keypad includes at least one push button or a flat panel membrane allowing a user to provide input.

54. The variable speed pumping assembly of claim 33, wherein the user input means allows a user to input a motor speed.

55. The variable speed pumping assembly of claim 33, wherein the user interface includes an interface cover.

56. The variable speed pumping assembly of claim 55, wherein the interface cover is pivotably mounted to the user interface, the interface cover being pivotable between a closed position covering the user input means and display, and an open position exposing the user input means and display.

57. The variable speed pumping assembly of claim 33, wherein the plurality of drive assembly apertures includes a first drive assembly aperture, a second drive assembly aperture, a third drive assembly aperture, and a fourth drive assembly aperture, the first drive assembly aperture being spaced a first predetermined distance from the second drive assembly aperture, the second drive assembly aperture being spaced substantially the first predetermined distance from the third drive assembly aperture, the third drive assembly aperture being spaced substantially the first predetermined distance from the fourth drive assembly aperture, and the fourth drive assembly aperture being spaced substantially the first predetermined distance from the first drive assembly aperture.

58. The variable speed pumping assembly of claim 57, wherein the plurality of interface apertures includes a first interface aperture and a second interface aperture, the first interface aperture being spaced substantially a second predetermined distance from the center point of the user interface, the second interface aperture being spaced substantially the second predetermined distance from the center point of the user interface.

59. The variable speed pumping assembly of claim 33, wherein the user interface is removably secured to the drive assembly by a fastening means.

60. The variable speed pumping assembly of claim 59, wherein the fastening means is a screw.

61. The variable speed pumping system of claim 33, wherein the user interface is configured to be removed from the drive assembly and mounted remotely from the drive assembly.

* * * * *